US010071456B2

(12) United States Patent
Rees et al.

(10) Patent No.: US 10,071,456 B2
(45) Date of Patent: Sep. 11, 2018

(54) AUTOMATED HARDWOOD TEXTURING SYSTEM AND ASSOCIATED METHODS

(71) Applicant: Columbia Insurance Company, Omaha, NE (US)

(72) Inventors: John J. M. Rees, Chattanooga, TN (US); Conrad Layson Fernandez, Dalton, GA (US); Eric John Levan, Ringgold, GA (US); David Emmett Milligan, Ringgold, GA (US); Leonard Lee Hixson, Jr., Lookout Mountain, GA (US); Edward Keith Huitt, Ringgold, GA (US); Robert Louis Shelnutt, III, Ringgold, GA (US); David Edward Voyles, Cleveland, TN (US); Gregory Kevin Espy, Summerville, GA (US); Roman Morris, Simpsonville, SC (US)

(73) Assignee: COLUMBIA INSURANCE COMPANY, Omaha, NE (US)

( * ) Notice: Subject to any disclaimer, the term of this patent is extended or adjusted under 35 U.S.C. 154(b) by 0 days.

(21) Appl. No.: 14/216,604

(22) Filed: Mar. 17, 2014

(65) Prior Publication Data

US 2014/0342125 A1 Nov. 20, 2014

Related U.S. Application Data

(60) Provisional application No. 61/793,364, filed on Mar. 15, 2013.

(51) Int. Cl.
*B24B 7/10* (2006.01)
*B24B 7/28* (2006.01)
(Continued)

(52) U.S. Cl.
CPC ..... *B24B 7/10* (2013.01); *B24B 7/28* (2013.01); *B27M 1/003* (2013.01); *B44F 9/02* (2013.01); *Y10T 428/24438* (2015.01)

(58) Field of Classification Search
CPC .. B24B 7/10; B24B 7/28; B27M 1/003; B44F 9/02; Y10T 428/24438
See application file for complete search history.

(56) References Cited

U.S. PATENT DOCUMENTS 1,958,203 A 5/1934 Pfau ..... 90/15
1,983,438 A 12/1934 Cushman ..... 90/15
(Continued)

FOREIGN PATENT DOCUMENTS

WO WO 2014/145660 3/2014

OTHER PUBLICATIONS

U.S. Appl. No. 61/793,364, filed Mar. 15, 2013, Gregory Kevin Epsy (Shaw Industries Group).
(Continued)

*Primary Examiner* — Marc Carlson
(74) *Attorney, Agent, or Firm* — Ballard Spahr LLP

(57) ABSTRACT

A system and method for imparting a textured surface effect in a board. The system and method are configured to releasably secure a charge on a table; determine a random abrasion pattern for the charge with at least one programmable controller; and control at least one abrasion assembly with the at least one programmable controller in accord with the random abrasion pattern to selectively engage and remove desired portions of the upper surface of the charge with the at least one abrasion assembly to form a randomized textured surface effect thereon.

49 Claims, 15 Drawing Sheets

(51) Int. Cl.
*B44F 9/02* (2006.01)
*B27M 1/00* (2006.01)

(56) References Cited

U.S. PATENT DOCUMENTS 2,236,093 A * 3/1941 Friend ..... B44D 3/162 15/236.06
2,479,588 A 8/1949 Dixon ..... 90/15
2,734,428 A 2/1956 Onsrud ..... 90/15
2,891,427 A 6/1959 Warsap ..... 77/55
2,940,489 A * 6/1960 Feiner ..... B24B 7/28 144/136.1
3,147,548 A 9/1964 Aspeck ..... 30/272
3,536,574 A * 10/1970 Buckley ..... B27D 5/00 144/358
3,703,198 A 11/1972 Luebs ..... 144/2
3,756,295 A * 9/1973 Halop ..... B27M 1/003 144/136.1
3,942,021 A 3/1976 Barr ..... 250/572
4,338,052 A 7/1982 Lockett ..... 409/206
4,945,959 A * 8/1990 Biedenbach ..... B27M 1/003 144/114.1
4,993,896 A 2/1991 Dombrowski ..... 409/138
5,081,734 A 1/1992 Sanford ..... 15/93.1
5,265,928 A 11/1993 Sonobe ..... 294/86.4
5,317,943 A * 6/1994 Dowdle ..... B23Q 11/0042 409/132
5,471,698 A * 12/1995 Francis ..... A47L 13/08 15/144.1
5,493,767 A 2/1996 Susnjara ..... 29/559
5,860,349 A * 1/1999 Takeda ..... B28D 1/225 83/76.6
5,987,217 A * 11/1999 Wisniewski ..... B27M 1/003 144/134.1
6,066,367 A * 5/2000 Nishibori ..... B27N 3/007 264/109
6,299,257 B1 10/2001 Constantino ..... 299/36.1
6,330,492 B1 12/2001 Wisniewski ..... 700/245
6,343,981 B1 2/2002 Buchanan ..... 451/350
6,523,906 B1 2/2003 Holder ..... 299/36.1
6,974,286 B2 12/2005 Lawson ..... 409/140
7,003,364 B1 2/2006 Hansson ..... 700/98
7,108,031 B1 9/2006 Secrest ..... 144/358
7,913,349 B2 * 3/2011 Byrnes ..... A47L 1/16 15/236.01
8,186,397 B2 5/2012 Hahn ..... 144/114.1
8,186,399 B2 * 5/2012 Tappan ..... B27M 1/003 144/356
2003/0066574 A1 4/2003 Lovchik ..... 144/382
2006/0156672 A1 * 7/2006 Laurent ..... B44C 1/24 52/589.1
2008/0148876 A1 * 6/2008 Hock ..... G01N 29/041 73/865.8
2009/0277537 A1 * 11/2009 Hahn ..... B27M 1/003 144/371
2011/0186180 A1 8/2011 Peronto ..... 144/363
2012/0192996 A1 * 8/2012 Hahn ..... B27M 1/003 144/136.1

OTHER PUBLICATIONS

International Search Report dated Aug. 7, 2014 for international patent application PCT/US2014/030464, published as WO 2014/145660 (Inventor: Rees// Applicant: Shaw Industries Group, Inc.) (2 pages).

* cited by examiner

AUTOMATED HARDWOOD TEXTURING SYSTEM AND ASSOCIATED METHODS

CROSS-REFERENCE TO RELATED APPLICATION

This application claims priority to U.S. Provisional Application No. 61/793,364, filed Mar. 15, 2013. The disclosure of the above-referenced application is hereby incorporated herein by reference in its entirety.

BACKGROUND

Field of the Invention

Implementations described herein relate to apparatuses, systems and methods for forming a textured surface on a panel. More particularly, in one aspect the present disclosure relates to apparatuses, systems and methods of using at least one abrasion assembly to form a textured effect, such as, for example, a hand-scraped effect such as a simulated rustic or distressed effect, on a surface of a panel.

Related Art

For centuries, wood has been the recognized and sought after material of choice for use in flooring of homes and buildings. In centuries past, wooden planks or panels were cut and hewn by hand. However, since the early 1800s, machines have been developed for efficient cutting and planing of machined wood paneling and flooring. Unfortunately, the machined panels or flooring lost much of their hand-hewn or individualistic appearance.

In recent decades, the types of wood boards have expanded to include solid wood flooring, engineered flooring (which is made from several layers of wood and often designed to withstand higher levels of humidity), and laminate flooring (which typically comprises a faux wood image applied to a base of particle board). Typically, the machined or engineered flooring products are produced to have a generally smooth, machine-finished appearance.

As contemplated herein, boards can comprise any boards suitable for use on a surface such as a wall board or panel or a flooring board. Textured boards can comprise but are not limited to boards with a wear surface that comprises natural wood, such as plain or solid wooden boards or boards comprising a wooden top layer, preferably a hard wooden top layer, glued on top of a core. Optionally, some embodiments are applicable to boards that do not have a natural wooden top layer or comprise materials that are not wooden. For example, texture can be applied to a core material, such as to a core comprising particle board, MDF (medium density fiberboard), HDF (high density fiberboard), homogeneous PVC resilient flooring, homogeneous non-PVC resilient flooring or synthetic materials.

There is a growing demand for textured panels having a surface effect that simulates the antique and aged appearance of old beams and planks that were hewn out of logs by hand with an adze or an axe. In order to reproduce the "distressed" or worn appearance of old wood floors, flooring companies have devised ways to artificially distress the planks. Generally, these distressing operations have involved the use of extensive manual labor to produce a random distressed appearance. The manual distressing process is generally accomplished using combinations of hand tools and hand techniques. Many do-it-yourself television shows provide instructions to individuals, demonstrating how to distress wood using techniques such as hitting the wood with hammers, chains, and other hard materials that create dents and cuts of different shapes and sizes. As can be appreciated, such a process can be very time and labor intensive and, even in those instances in which the results are satisfactory, tends to increase the cost of the manufactured covering. Also, it is difficult to achieve a consistent look using manual distressing, which inhibits consumers from later purchasing a substantially similar product in order to cover additional floor space. Even further, manual distressing techniques are not well suited to many flooring types, such as engineered wood flooring. For example, the manual distressing technique of scraping may cut through the thin veneer on engineered wood flooring.

Alternatively, machining has been used to attempt to produce a hand-hewn appearance. Typically however, machine distressing of the panels has generally produced a "machined" distressed appearance that has a noticeable or repeated pattern. Conventional machine texturing of boards with various dimensions in an economic way is not straightforward. Thus, there is a need for apparatuses, systems and methods for producing a hand-scraped or distressed appearance to surfaces of flooring panels.

SUMMARY OF THE INVENTION

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

In accordance with the purpose(s) of the present disclosure, as embodied and broadly described herein, this present disclosure, in one aspect, relates to systems and methods for monitoring, improving and/or controlling the texture of a display surface of a board, such as a flooring board or a wall panel.

In one aspect, a system and method for imparting a textured surface effect in a board is presented. The system and method are configured to releasably secure a charge on a table; determine a random abrasion pattern for the charge with at least one programmable controller; and control at least one abrasion assembly with the at least one programmable controller in accord with the random abrasion pattern to selectively engage and remove desired portions of the upper surface of the charge with the at least one abrasion assembly to form a randomized textured surface effect thereon the upper surface of the charge.

Additional features and advantages of exemplary implementations of the present disclosure will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The accompanying drawings, which are incorporated in and constitute a part of this specification, illustrate several aspects of the present disclosure and together with the description, serve to explain the principles of the present disclosure. Like numbers represent the same elements throughout the figures.

DETAILED DESCRIPTION

Figure 1:
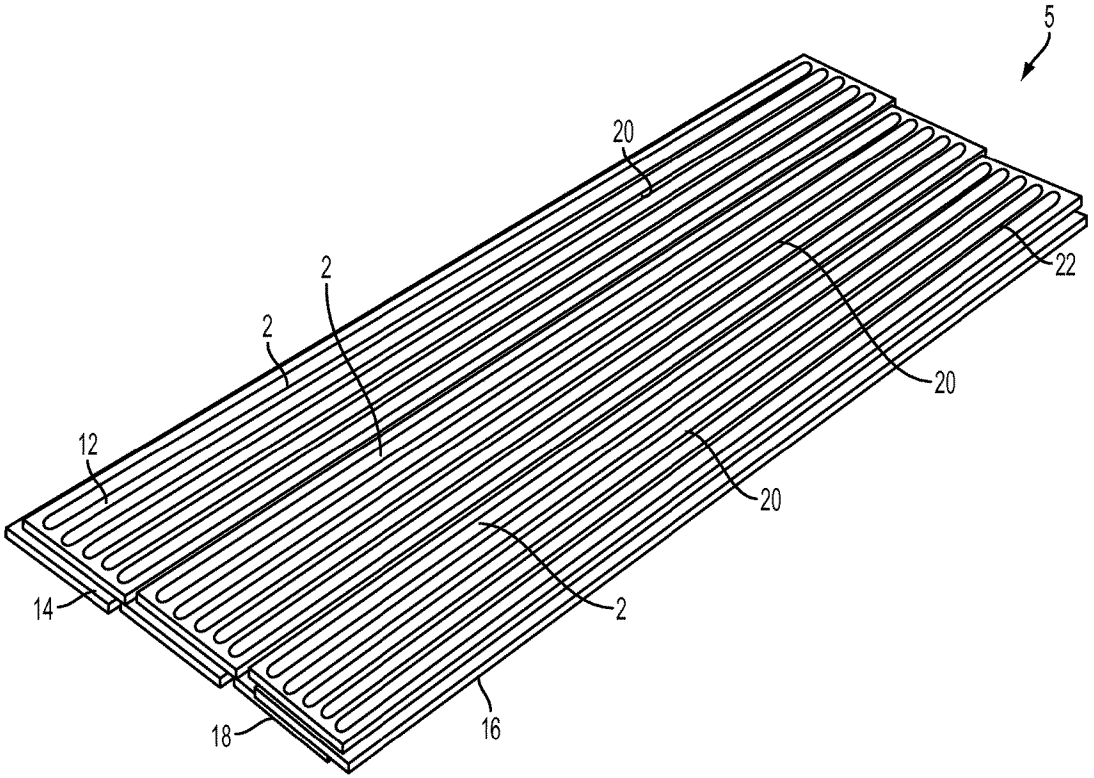
FIG. 1 is a perspective view of an exemplary charge showing a plurality of boards extending parallel to a longitudinal axis L of the charge.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a texture mark" can include two or more such texture marks unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance can or cannot occur, and that the description includes instances where said event or circumstance occurs and instances where it does not.

As contemplated herein, boards can comprise any boards suitable for use on a surface such as a wall board, a panel, a flooring board, a ceiling tile, a ceiling board, a wood countertop, a door, a cabinet panel, a cabinet door and the like. Textured boards can comprise but are not limited to boards with a wear surface that comprises natural wood, such as plain or solid wooden boards or boards comprising a wooden top layer, preferably a hard wooden top layer, glued on top of a core. Optionally, some embodiments are applicable to boards that do not have a natural wooden top layer or comprise materials that are not wooden. For example, texture can be applied to a core material, such as to a core comprising particle board, MDF (medium density fiberboard), HDF (high density fiberboard), homogeneous PVC resilient flooring, homogeneous non-PVC resilient flooring or synthetic materials.

The present invention can be understood more readily by reference to the following detailed description of preferred embodiments of the invention and the examples included therein and to the Figures and their previous and following description.

In one broad aspect, the present disclosure comprises apparatuses, systems and methods for forming a textured surface on a board or panel. More particularly, in one aspect the present disclosure comprises apparatuses, systems and methods of using at least one abrasion assembly to form a textured effect, such as, for example, a hand-scraped effect such as a simulated rustic or distressed effect, on a surface of a panel. In light of the present disclosure, one skilled in the art will appreciate that the look of flooring produced by the disclosed systems and methods can provide a substantially consistent look that can be repeatable over time with minor variance. Further, the pressures used to texture the boards or panels can be substantially even or otherwise controlled and, additionally or alternatively, machine vision can be used, so as to avoid creating defects by, for example, tearing out knots. Even further, such flooring systems and methods reduce the labor cost of producing wood flooring products based on textured boards or panels as described herein.

Figure 2:
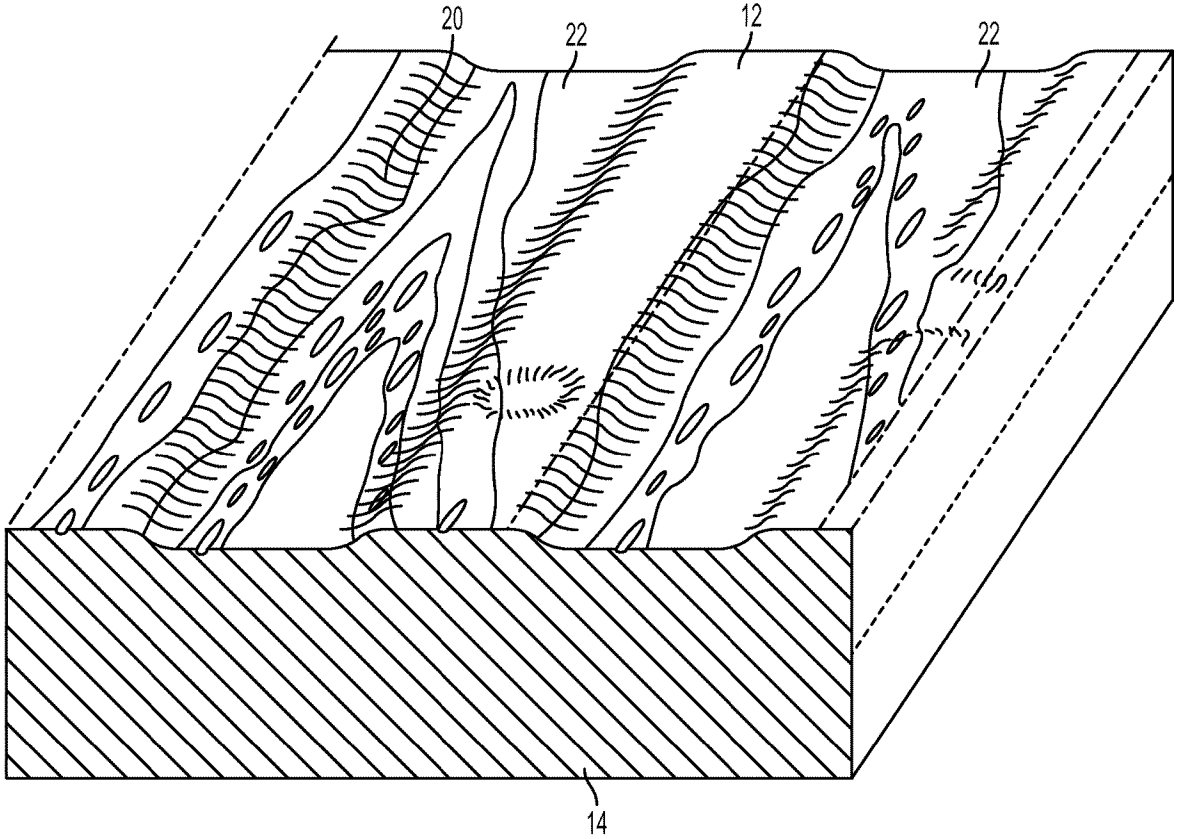
FIG. 2 is a cross-sectional view of a portion of a board after the texture marks are applied, showing the upper surface of each board being patterned with a randomized distressed surface effect.
Figure 3:
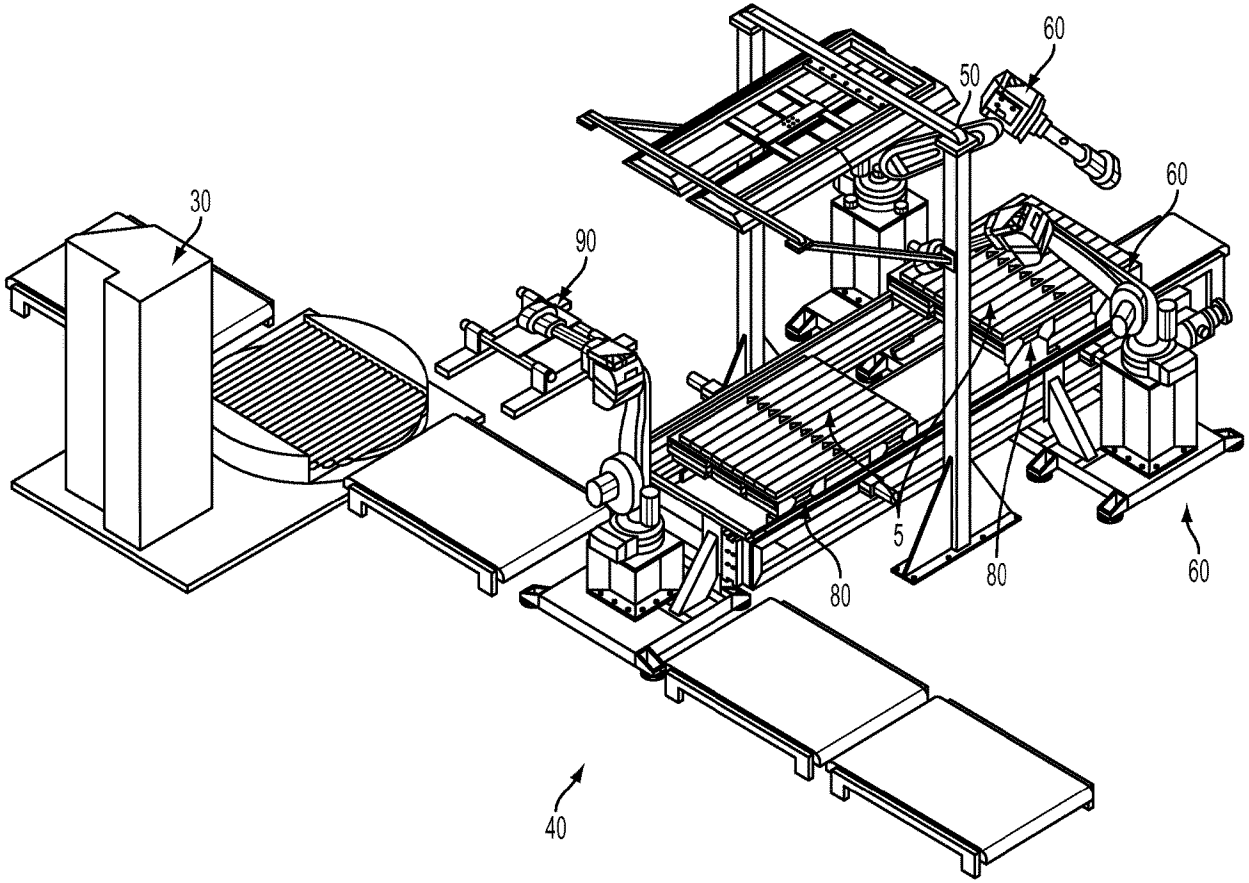
FIG. 3 is a perspective view of the texturing system, showing a pair of opposed texturing assemblies, a shuttle assembly and a transfer assembly.
Figure 4:
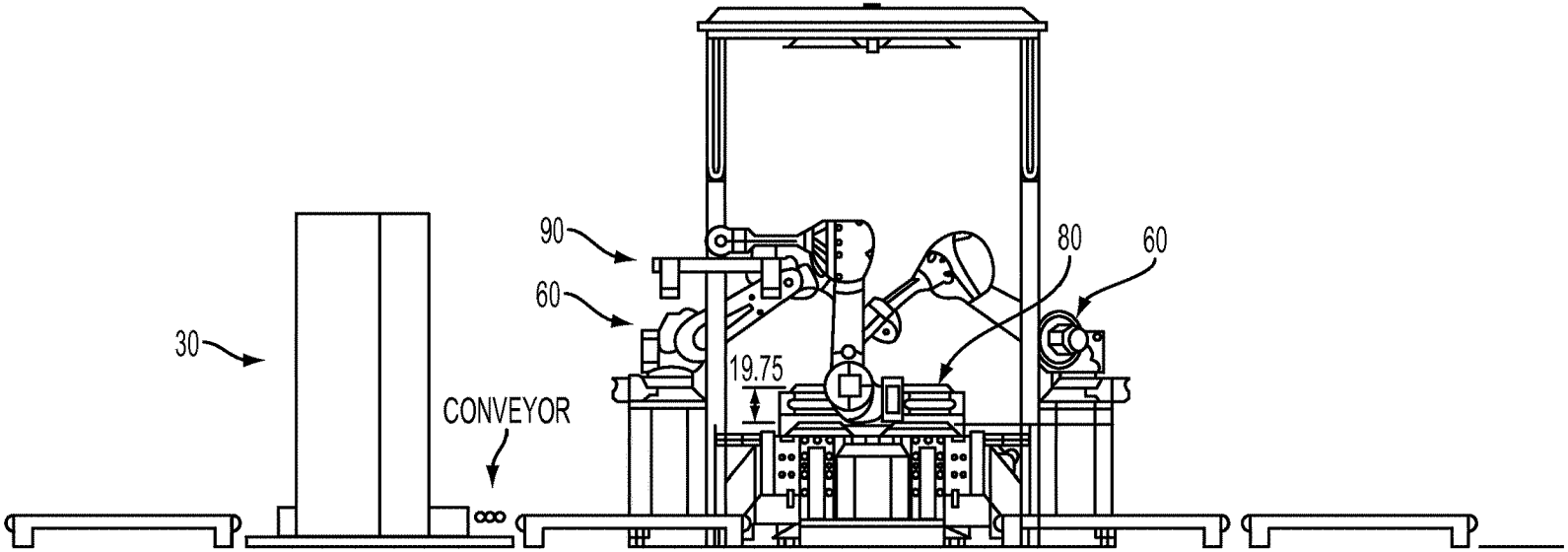
FIG. 4 is a side view of the texturing system of FIG. 3.
Figure 5:
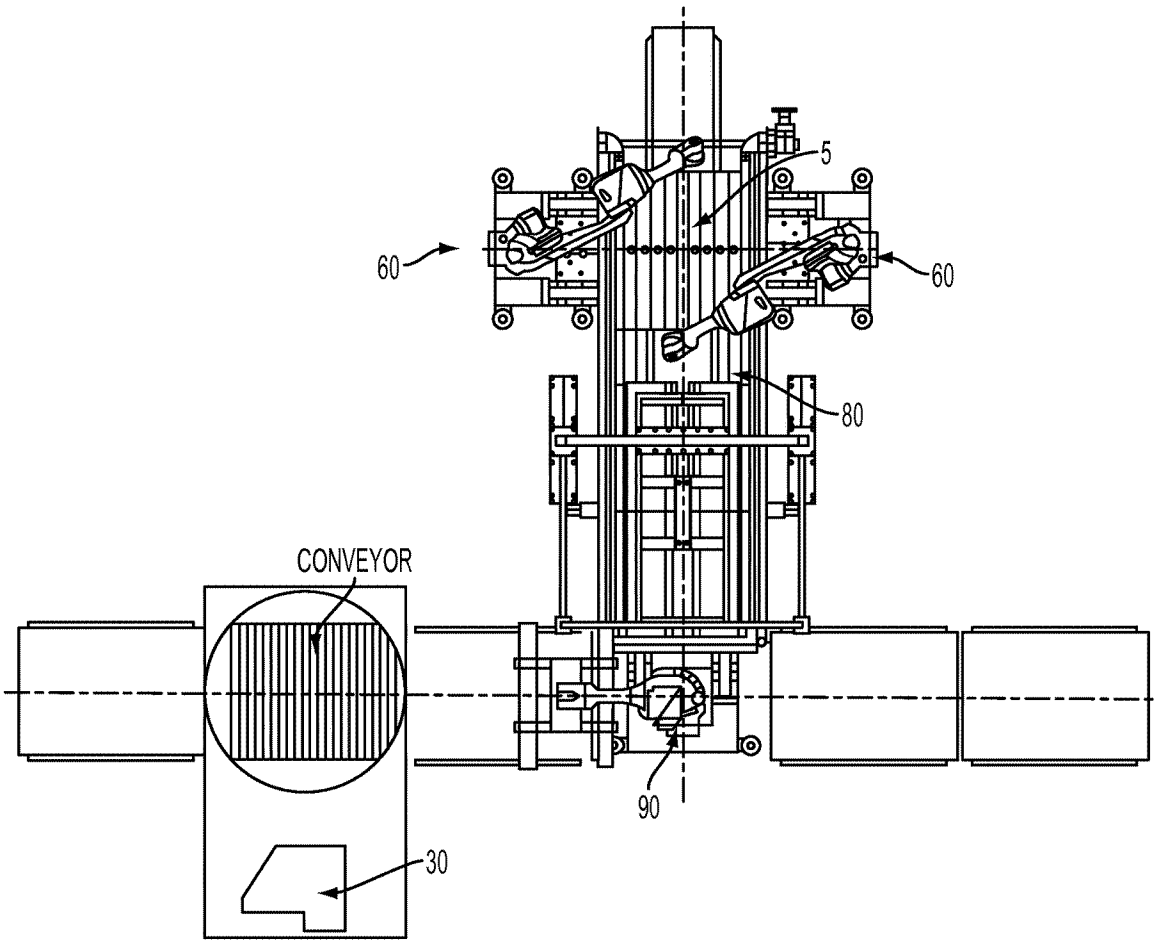
FIG. 5 is a top elevational view of the texturing system of FIG. 3.
Figure 6:
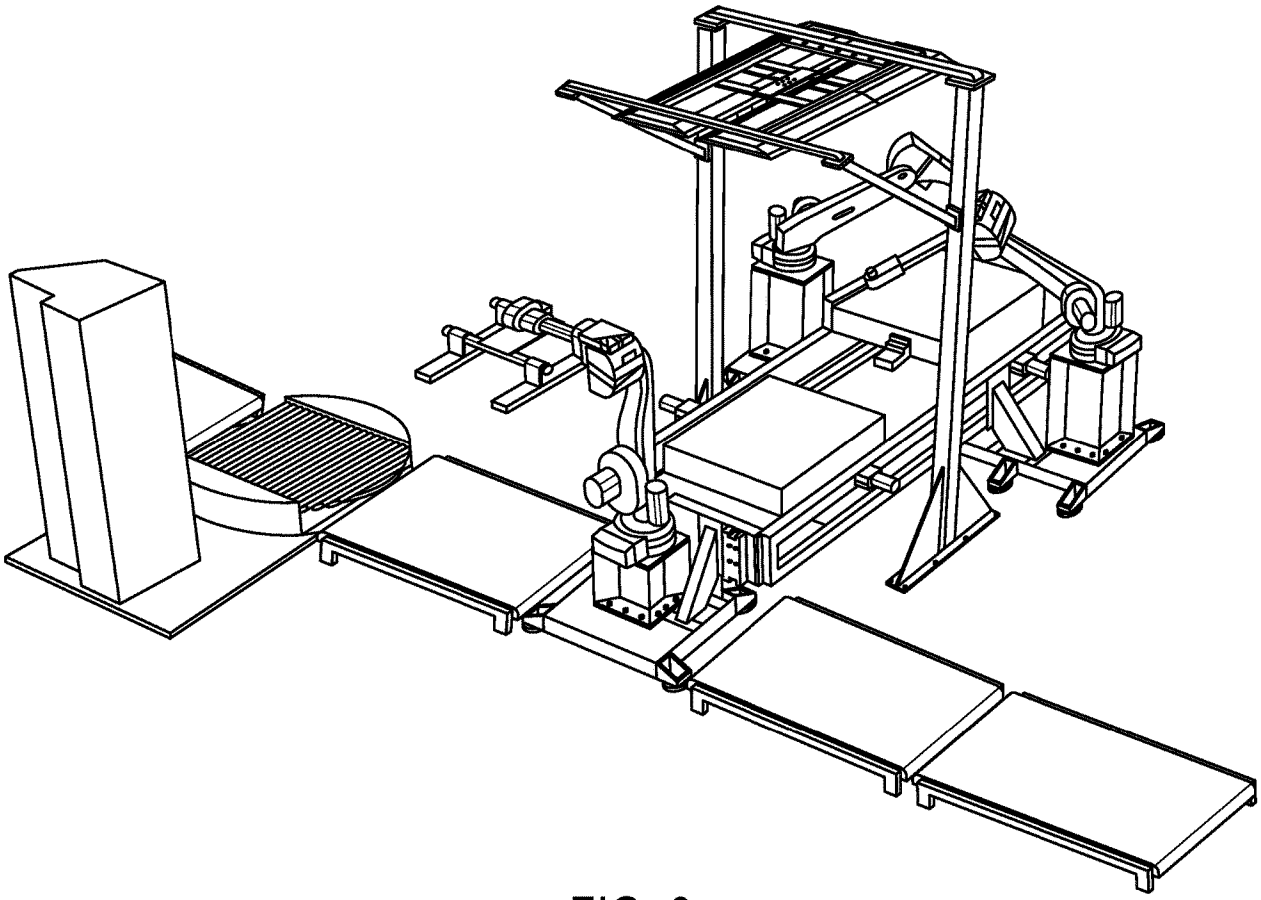
FIG. 6 is a perspective view of the texturing system OF FIG. 3.

In one aspect and referring to FIGS. 1 and 2, a charge 5 comprises at least one board 2. In a more particular aspect, the charge 5 can comprise a plurality of boards 2. Each board can be used as desired by a user. Thus, it can be contemplated that a board can comprise a flooring board, a wall board and the like. In one aspect, an exemplary board 10 can comprise a pair of opposed major surfaces; a larger upper surface 12 and an opposing larger lower surface 14. In general and without limitation, the opposed upper and lower surfaces 12, 14 can be generally planar and can be generally rectangular shaped. In various aspects, a pair of long side edge surfaces 16 and a pair of short side edge surfaces 18 extend between the opposed upper and lower surfaces 12, 14.

In one aspect, the upper surface of a board product produced by the methods described herein comprises a randomized distressed surface effect 20. As one skilled in the art will appreciate, the randomized distressed surface effect 20 can impart a simulated rustic or distressed surface effect to the upper surface of the board product. In one aspect, the randomized distressed surface effect can comprise a plurality of texture marks 22. In this aspect, the texture marks 22 can be randomly dispersed on the upper surface of the board product by an automated texturing system and method described in more detail below. In optional aspects, the texture marks 20 forming the randomized distressed surface effect 20 can be provided by one or more automated operations including conventional material removal modalities such as, for example but not limited to, scraping, denting, brushing, sanding, roughening, burning, sawing, routing, and the like.

In one aspect, it can be contemplated that the texture marks 20 forming the randomized distressed surface effect 20 can be essentially oriented to extend generally parallel to a longitudinal axis of the charge, which can be generally parallel to the longitudinal axis of the individual boards comprising the charge, i.e., essentially parallel to the long side edge surfaces of each board. In a further aspect, it is contemplated that substantially the entire upper surface of the board can be provided with the texture marks 20. Optionally, select portions of the board can be provided with the texture marks. In this aspect, the select portions of the board that have the texture marks can be positioned substantially parallel to the longitudinal axis of the individual boards.

As noted, it is contemplated that the charge can comprise a plurality of boards that have a longitudinal axis. In this aspect, it is contemplated that the plurality of boards can be positioned in adjoining relationship in which all of the longitudinal axes of the plurality of boards can be positioned substantially parallel to the longitudinal axis of the charge.

In one aspect, the texture marks 22 forming the randomized distressed surface effect 20 can be applied to imitate wood from which wood portions have been removed from the surface by means of a tool, more particularly an imitation of so-called scraped wood. When imitating scraped wood or the like, preferably portions can be removed that extend in the form of longitudinal paths. In various examples, each path can extend only a portion of the longitudinal length of the board or can extend the substantially the longitudinal length of the board. One skilled in the art will appreciate that the automated texturing system and method described herein allows the number of longitudinal paths to be randomly varied by randomly altering patterns in between the texturing of subsequent charges.

In one aspect, it is contemplated that the long side edge surfaces 16 of the board 10 can be configured with means for selectively adjoining substantially parallel boards. For example and without limitation, the long side edge surfaces 16 of the board 10 can be conventionally configured with a tongue and a groove for the side-to-side connection of parallel boards. Further, if desired, the short side edge surfaces 18 the board can also be respectively provided with conventional tongue and groove features for the end-to-end connection of aligned boards. It will be appreciated that it is contemplated that in alternative embodiments, one or more of the tongue and groove features can be omitted. As one skilled in the art will appreciate, conventional tongue and groove construction allows for a glue-less coupling of the boards or for a connection executed with application of glue, staples or nailing.

In one aspect, the texture marks 22 can comprise a series of peaks and valleys that extend in a generally longitudinal direction along the upper surface 12 of the board 10. In optional aspects, the peaks and valleys can extend in a discontinuous fashion and/or in varying directions and depths along the upper surface of the board. It is contemplated that texture marks that deviate from a substantially longitudinal direction can be provided to generate a more realistic hand carved distressed surface effect. In this aspect, at least some of the texture marks can extend at an angle relative to the longitudinal axis of the board. Of course, in addition to the texture marks 22 applied by the method and system described herein, other areas of visual interest can be present on the upper surface of the board. In various aspects, the areas of interest can comprise, for example and without limitation, wood grain, worm holes, wood rot, stains, knots, other naturally occurring textures and defects, other man-effected textures and defects, and the like.

FIG. 1 illustrates exemplary textured boards that are coupled together conventionally. The boards can be configured such that respective long side edge surfaces 16 of the adjoining boards form a joint between the boards. In one aspect, this can give the transition from one board to the next a smoothed or continuous appearance. Optionally, the respective long side edge surface of the adjoining boards can be spaced apart a desired distance at the formed joint. This spaced transition from one board to the next can provide a visually rougher, more textured look. In yet another option, respective long side edge surfaces can have beveled upper edges (the juncture of the long side edge surfaces and the upper surface of the board) to form a recessed channel at the joint between the adjoined boards. In these optional aspects, the respective edge surfaces of the board can be formed to a desired fit and visual appearance at the joint by a conventional milling operation that forms the tongue and groove joinery and/or the machine operation that forms the texture marks 22. It is contemplated that, in the event of a separate milling operation, the joint configuration at the board's side edge surfaces can be executed either prior to or after the automated operation that forms the randomized distressed surface effect on the upper surface of the charge.

In one non-limiting example, the conventional coupling of adjoining boards can be achieved by positioning the tongue of one board at an incline with respect to another board and subsequently inserting the inclined tongue into the groove of the other board. After insertion, the inclined board can be rotated until it is co-planar to the other board to mechanically complete the coupling. In this example, it is contemplated that the respective tongue and groove configurations include conventional cooperating features to achieve coupling in both a vertical direction and in a horizontal direction. In another conventional example, the coupling of the adjoining boards can be completed by inserting the tongue of one board into the groove of another board by shifting the boards towards each other in a substantially horizontal fashion, i.e., essentially without inclining either board. During insertion, a lip of the groove can elastically deflect to complete the coupling. It is however not excluded that only one of either rotating or horizontally shifting is possible. According to still another example, the mechanical coupling between adjoining boards can be formed by inserting the tongue of one board into the groove of another board with a downward vertical movement. As one skilled in the art will appreciate, exemplary tongue and groove connections can be shaped to achieve mechanical coupling only in a horizontal direction or only in a vertical direction.

In a further aspect, while it is contemplated the texturing system and methods described herein can be well suited for boards having a solid wood structure; the present disclosure is not intended to be limited as to the composition or structure of the underlying board. One skilled in the art will appreciate that the randomized distressed surface effect can be suitably applied to numerous and varied types of boards, whether flooring boards or wall boards or panels.

In one example, boards can have a wear surface that comprises natural wood. Optionally, the wear surface of a board can further comprise one or more synthetic layers, such as lacquers, applied on top of the natural wood. Such a synthetic layer can be filled with abrasion resistant particles, such as aluminum oxide or the like. In general, the wear surface includes all layers or materials that contribute to the visual aspect of the board. It can be this portion of the board that can be subject to wear when in use. In one aspect, the synthetic layer can be preferably applied at least partially, and more preferably applied wholly, after the texture marks 22 have been applied to the board. In this way, it can be possible that the texture marks 22 can be applied in the natural wood that is comprised in the wear layer and that the texture marks 22 remain visible and/or palpable even when synthetic layers are applied on top of the already textured natural wood of the wear layer.

In a further example, a board 22 having a multi-layered structure can be used. In this aspect, the upper layer forms part of the wear surface of the board. For example and without limitation, the multi-layer structure forming an engineered board can comprise at least two of a lower ply, an intermediate ply, and an upper ply that can be conventionally connected or laminated together. Such multi-layered structures and suitable materials are well known in this art. In one aspect, the upper ply can comprise natural wood, preferably hard wood.

In one aspect, the randomized texture marks 22 can be provided in the upper ply without extending through the upper ply. In alternative embodiments, at least some of the texture marks 22 can be formed to penetrate through the upper ply and extend into and/or expose one or more of the underlying plies. Thus, in optional aspects, it is contemplated that the texture marks comprising the randomized distressed surface effect can be provided, for example and without limitation on a board fabricated from engineered wood, composite wood, derivative wood products, non-wood materials, homogeneous PVC resilient flooring, homogeneous non-PVC resilient flooring and the like.

Referring now to FIGS. 3-14B, an exemplary automated texturing system 40 for imparting the desired randomized textured marks and surface texture is shown. In one aspect, the system can comprise at least one abrasion assembly 60, at least one shuttle assembly 80, and at least one transfer assembly 90. FIGS. 3-6 show perspective/elevational views of the embodied texturing system. As shown, the transfer assembly 90, here shown as a robotic crane lifter, such as manufactured by ABB Inc., Model No. IRB 4600 that can be configured, under control of a programmable computer, to selectively lift charges that are typically stacked at a staging station. The robotic crane lifter can be configured to lift at least one single charge 5 onto a desired position onto a surface of a table of the shuttle system where the charge can be selectively secured until the randomized textured surface effect thereon the upper surface of the charge has been formed. In one aspect, it can be contemplated that the robotic crane lifter can be programmed or controlled to selectively position the charge to a predetermined position relative to both a center point of the table and the longitudinal axis of the table, upon which the change can be selectively and releasably secured on the table.

The automated texturing system 40 can also comprise a vision assembly that can be configured to scan the upper surface of the charge 5 that can be fixed relative to the table of the shuttle assembly 80 to identify any areas of interest on the upper surface of the charge and to process the respective charge image to the programmable controller for analysis. Optionally, the vision assembly can be configured to scan the upper surface of the charge that can be fixed relative to the table of the shuttle assembly to determine the position of the longitudinal axis of the charge relative to the machine direction in the texturing position. It is also contemplated that the vision assembly can be configured to operate under control of the programmable controller 30 to position the charge on the table in the desired position. The machine vision system can deliver multiple results: (1) locate an unscraped charge's position on the vacuum hold-down shuttle plate and feed the location back to the robots for where to start and stop scraping. (2) confirm that the scraping pattern was properly performed after scraping from a quality point of view (3) inspect the unscraped charge for wood defect locations, such as knots, mineral deposits and the like and feed these locations and size back to the robot for scraping around or thought the defect with little or no pressure, preserving tool life (4) inspect the scraped charge for a chipped tooling blade that leaves a linear mark in the scraped valleys.

After being scanned, at least one programmable controller 30 can determine a random abrasion pattern for the charge 5. In various optional aspects, the programmable controller can use random programming of selected system parameters to generate the random scraping pattern. For example, and without limitation the system parameters can comprise at least one of: blade pressure, blade angle, number of scrapes, lane change locations, valley distances from edges, valley depth, chatter intensity, chatter locations, valley locations, and the like.

System parameters for an abrasion assembly 60 comprising at least one scraping blade can further comprise, for example and without limitation:

| Parameter | Description | Default Value | Units |
|---|---|---|---|
| ParameterSettingID | Identification number for this given set of parameters | | |
| ParameterSettingDescription | Description of the given set of parameters | | String |
| MotionPassApproachAngle | Random value between MotionPassApproachAngleMin and MotionPassApproachAngleMax | | |
| MotionPassApproachAngleMin | Approach angle when scraping board cannot be lower than this angle | 0 | Degrees |
| MotionPassApproachAngleMax | Approach angle when scraping board cannot be greater than this angle | 45 | Degrees |
| MotionPassApproachDistance | Random value between MotionPassApproachDistanceMin and MotionPassApproachDistanceMax | | |
| MotionPassApproachDistanceMin | Approach distance when scraping board cannot be lower than this distance | 3 | Inches |
| MotionPassApproachDistanceMax | Approach distance when scraping board cannot be greater than this distance | 5 | Inches |
| MotionPassApproachPressure | Tool pressure during approach segment | | |
| MotionPassApproachPressureRate | Rate of pressure change from Initial to Target | | |
| MotionPassApproachPressureInitial | Initial pressure value | | |
| MotionPassApproachPressureTarget | Target pressure value | | |
| MotionPassExitAngle | Random value between MotionPassExitAngleMin and MotionPassExitAngleMax | | |
| MotionPassExitAngleMin | Exit angle when scraping board cannot be lower than this angle | 10 | Degrees |
| MotionPassExitAngleMax | Exit angle when scraping board cannot be greater than this angle | 45 | Degrees |
| MotionPassExitDistance | Random value between MotionPassExitDistanceMin and MotionPassExitDistanceMax | | |
| MotionPassExitDistanceMin | Exit distance when scraping board cannot be lower than this distance | 5 | Inches |
| MotionPassExitDistanceMax | Exit distance when scraping board cannot be greater than this distance | 8 | Inches |
| MotionPassVelocity | Random value between MotionPassVelocityMin and MotionPassVelocityMax | | |
| MotionPassVelocityMin | Minimum speed during motion segments | | |
| MotionPassVelocityMax | Maximum speed during motion segments | | |
| MotionPassAOIVelocity | Random value between MotionPassAOIVelocityMin and MotionPassAOIVelocityMax | | |
| MotionPassAOIVelocityMin | Minimum speed during travel through area of interest (AOI). | | |
| MotionPassAOIVelocityMax | Maximum speed during travel through area of interest (AOI). | | |
| ToolPressure | Auxiliary axis pressure during motion pass. It is a random value between ToolPressureMin and ToolPressureMax | | |
| ToolPressureMin | Auxiliary axis to control tool pressure. This can be the minimum pressure allowed. | 10 | psi |
| ToolPressureMax | Auxiliary axis to control tool pressure. This can be the maximum pressure allowed. | 50 | psi |
| ToolPressureAOI | Axillary axis pressure while travelling through AOI. This value can be a random number between ToolPressureAOIMin and ToolPressureAIOMax | | |
| ToolPressureAOIMin | Auxillary axis to control tool pressure when entering area of interest (AOI). This can be the minimum pressure allowed. | | psi |
| ToolPressureAOIMax | Auxillary axis to control tool pressure when entering area of interest (AOI). This can be the maximum pressure allowed. | | psi |
| ToolPressureAOIEntry | Tool pressure when entering area of interest (AOI). | | |
| ToolPressureAOIEntryRate | Rate of pressure change from Initial to Target | | |
| ToolPressureAOIEntryInitial | Initial pressure value | | |
| ToolPressureAOIEntryTarget | Target pressure value | | |
| ToolPressureAOIExit | Tool pressure when exiting area of interest (AOI). | | |

-continued

| Parameter | Description | Default Value | Units |
|---|---|---|---|
| ToolPressureAOIExitRate | Rate of pressure change from Initial to Target | | |
| ToolPressureAOIExitInitial | Initial pressure value | | |
| ToolPressureAOIExitTarget | Target pressure value | | |
| ZoneTolerance | Target tolerance for a given point in motion scrape segment. | | |
| ZoneToleranceMin | Defines how close to target before moving to next target. This can be the minimum tolerance value. | | Inches |
| ZoneToleranceMax | Defines how close to target before moving to next target. This can be the maximum tolerance value. | | Inches |
| | The following 7 parameters will accommodate a tool with multiple blades. | | |
| MotionPassToolBladeOffsetMin | Minimum shift along width of charge after each motion pass. | | Inches |
| MotionPassToolBladeOffsetMax | Maximum shift along width of charge after each motion pass. | | Inches |
| NumberofToolBladesShifts | Number of motion passes before using MotionPassToolOffset. | | |
| MotionPassToolOffsetMin | Minimum shift along width of charge after NumberofToolBladesShifts has been generated. | | Inches |
| MotionPassToolOffsetMax | Maximum shift along width of charge after NumberofToolBladesShifts has been generated. | | Inches |
| BladeWidth | Cutting width of given blade | | |
| BladeCenterToCenter | Distance between blade center position. | | |
| MotionPassStartOffset | Defines the offset in the Y axis position where to start a motion pass. This offset is relative to the center of the charge. The top of the charge is where Y = 0. The bottom of the charge is where Y = length of charge. Add this offset if moving from center to top of charge. Subtract this offset if moving from center to bottom of charge. | | |
| MotionPassStartOffsetMin | This is the minimum offset added or subtracted from the midpoint of the charge length dimension. | | Inches |
| MotionPassStartOffsetMax | This is the maximum offset added or subtracted from the midpoint of the charge length dimension. | | Inches |
| MotionPassYawAngle | End effector Yaw angle for a given point in a motion scrape segment | | |
| MotionPassYawMin | End effector Yaw cannot be lower than this angle | | Degrees |
| MotionPassYawMax | End effector Yaw cannot be greater than this angle | | Degrees |
| MotionPassPitchAngle | End effector Pitch angle for a given point in a motion scrape segment | | |
| MotionPassPitchMin | End effector Pitch cannot be lower than this angle | | Degrees |
| MotionPassPitchMax | End effector Pitch cannot be greater than this angle | | Degrees |
| MotionPassRollAngle | End effector Roll angle for a given point in a motion scrape segment | | |
| MotionPassRollMin | End effector Roll cannot be lower than this angle | | Degrees |
| MotionPassRollMax | End effector Roll cannot be greater than this angle | | Degrees |
| MotionPassAOIYawAngle | End effector Yaw angle for a given point in a motion scrape segment which crosses an AOI | | |
| MotionPassAOIYawMin | End effector Yaw cannot be lower than this angle when encountering Area of Interest. | | Degrees |
| MotionPassAOIYawMax | End effector Yaw cannot be greater than this angle when encountering Area of Interest. | | Degrees |
| MotionPassAOIPitchAngle | End effector Pitch angle for a given point in a motion scrape segment which crosses an AOI | | |
| MotionPassAOIPitchMin | End effector Pitch cannot be lower than this angle when encountering Area of Interest. | | Degrees |

-continued

| Parameter | Description | Default Value | Units |
|---|---|---|---|
| MotionPassAOIPitchMax | End effector Pitch cannot be greater than this angle when encountering Area of Interest. | | Degrees |
| MotionPassAOIRollAngle | End effector Roll angle for a given point in a motion scrape segment which crosses an AOI | | |
| MotionPassAOIRollMin | End effector Roll cannot be lower than this angle when encountering Area of Interest. | | Degrees |
| MotionPassAOIRollMax | End effector Roll cannot be greater than this angle when encountering Area of Interest. | | Degrees |
| AdjustOnAOIExit | If set to True, Adjust tool and auxiliary axis parameters on AOI Exit. Otherwise, Adjust tool and auxiliary axis parameters on AOI Entry. | | Boolean |
| MotionPassesPerCharge | Number of motion passes for a given charge | | |
| MotionPassesPerChargeMin | Number of motion passes to execute for a given charge has to be at least this number. | | |
| MotionPassesPerChargeMax | Number of motion passes to execute for a given charge cannot exceed this number. | | |
| MotionPassTargets | Number of target location for a given motion pass | | |
| MotionPassTargetMin | Number of target locations for each motion pass has to be at least this number. | | |
| MotionPassTargetMax | Number of target locations for each motion pass cannot exceed this number. | | |
| | Parameters used to filter out AOI list | | |
| MinimumAOIWidth | Minimum width for Area of Interest. Not processed if AOI width is less than this value. | | Inches |
| MaximumAOIWidth | Maximum width for Area of Interest. Not processed if AOI width exceeds this value. | | Inches |
| MinimumAOIHeight | Minimum height for Area of Interest. Not processed if AOI height is less than this value. | | Inches |
| MaximumAOIHeight | Maximum height for Area of Interest. Not processed if AOI height exceeds this value. | | Inches |
| | Parameters used to validate that Charge of acceptable dimensions has occurred | | |
| MinimumChargeWidth | Minimum width for Charge. Not processed if Charge width is less than this value. | | Inches |
| MaximumChargeWidth | Maximum width for Charge. Not processed if Charge width exceeds this value. | | Inches |
| MinimumChargeHeight | Minimum height for Charge. Not processed if Charge height is less than this value. | | Inches |
| MaximumChargeHeight | Maximum height for Charge. Not processed if Charge height exceeds this value. | | Inches |

In other aspects and in order to increase the rate of production of a charge 5, two abrasion assemblies 60 can be provided. In one aspect, each abrasion assembly can comprise a scraping gantry. With two gantries scraping simultaneously, there is a risk of the gantries crashing. Thus, in order to avoid such an event, it is contemplated that the automated texturing system 40 can be adapted to recognize detection zones. Prior to the programmable controller causing one abrasion assembly to actuate, the system can be programmed or otherwise configured to query or poll the system 40 to ensure that the abrasion assembly 60 will not enter an area where the second abrasion assembly is operating. In an alternative aspect, the tooling assembly comprises a robotic component and such a crash-prevention algorithm is embedded therein, providing the benefit of increased reliability due to decreased response time of the abrasion assembly 60 of the tooling assembly.

In one aspect, it is contemplated that at least one of the system parameters can be randomly varied from a set value for a particular design recipe to create a different random scraping pattern for each charge 5. In a further aspect, each system parameter can be assigned a predetermined range of variance for a selected randomized style and/or design recipe. In this aspect, the predetermined range of variance can be the same or it can vary for each randomized style and/or design recipe. All scraped products can be randomly generated. Each parameter setting has a minimum and maximum value for its settings. Each minimum and maximum value can be changed. The actual value used for scraping can be randomly selected within that range.

In an optional aspect, the programmable controller 30 can further comprise a random number generator that can be configured to allow for the random selection of a value for each system parameter to generate the random scraping pattern. In this aspect, it is contemplated that each system parameter can be assigned a predetermined range of variance from which the value for system parameter can be selected. In this aspect, the predetermined range of variance can be the same or it can vary for each randomized style and/or design recipe.

Figure 8:
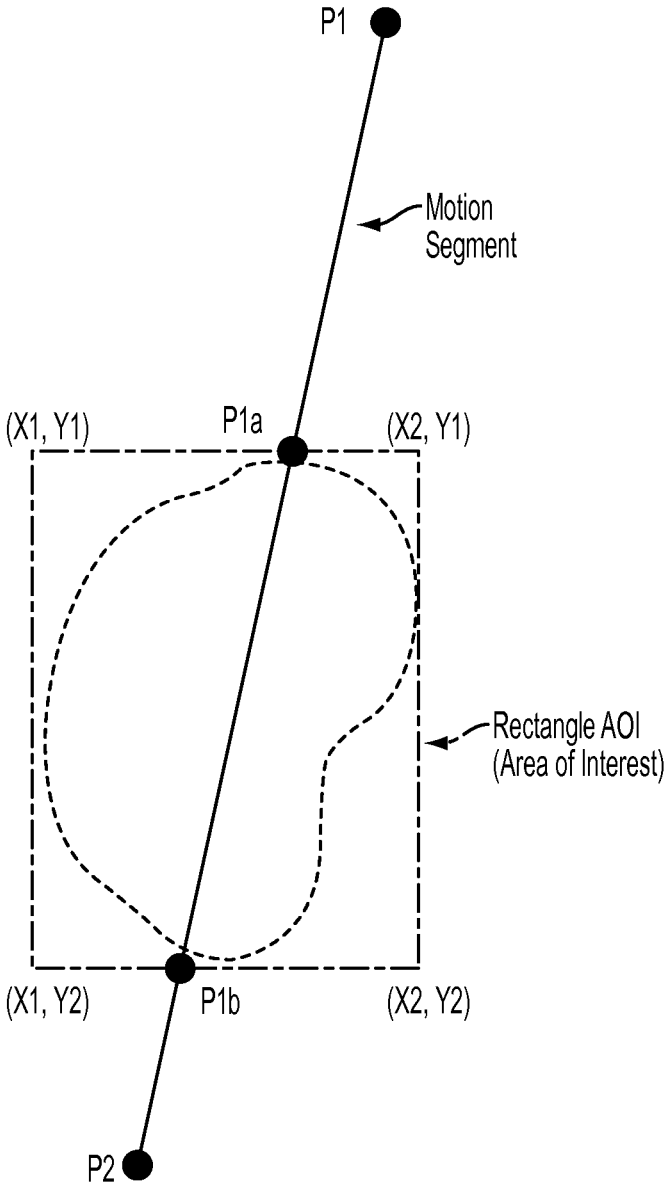
FIG. 8 is a schematic diagram of the vision assembly modality for determining the location and size of each Area of Interest (AoI) determined from an image taken of the charge.

In operation, and as exemplarily shown in FIG. 8, the programmable controller 30 can be programmed to define each rectangular area of interest by four coordinates e.g. (X1, Y1), (X2, Y1), (X1, Y2), and (X2, Y2). In one aspect, the system parameters can further comprise identified areas of interest. It is also contemplated that at least one system parameter can be changed in each scraped segment that bisects any defined rectangular area of interest.

As described above, each rectangular area of interest can bound each identified area of interest on the upper surface of the charge 5. The programmed random pattern generation system can be configured to check each motion segment of each abrasion assembly 60 to determine if the motion segment crosses any defined areas of interest on the charge. In one aspect, if the motion segment crosses any defined areas of interest on the charge, the motion segment can be split into a plurality of sub-motion segments, which can allow for fine control and adjustment over the abrasion assembly 60 across all of the sub-motion segments to provide for desired texturing of the upper surface of the charge.

Referring to FIG. 8, in one aspect, the motion segment from P1 to P2 crossed the defined rectangular area of interest. Therefore, the motion segment P1-P2 can be split into sub-motion segments P1-P1a, P1a-P1b, and P1b-P2. Of course, it is contemplated that more or less than three sub-motion segments can be used or otherwise defined. In operation, when the abrasion assembly 60 reaches P1a, system values, such as pressure, speed and the like, can be adjusted to a new setting. Upon reaching P1b, the system values can be restored to the original randomized pattern value as the abrasion system has exited the defined area of interest.

Figure 9:
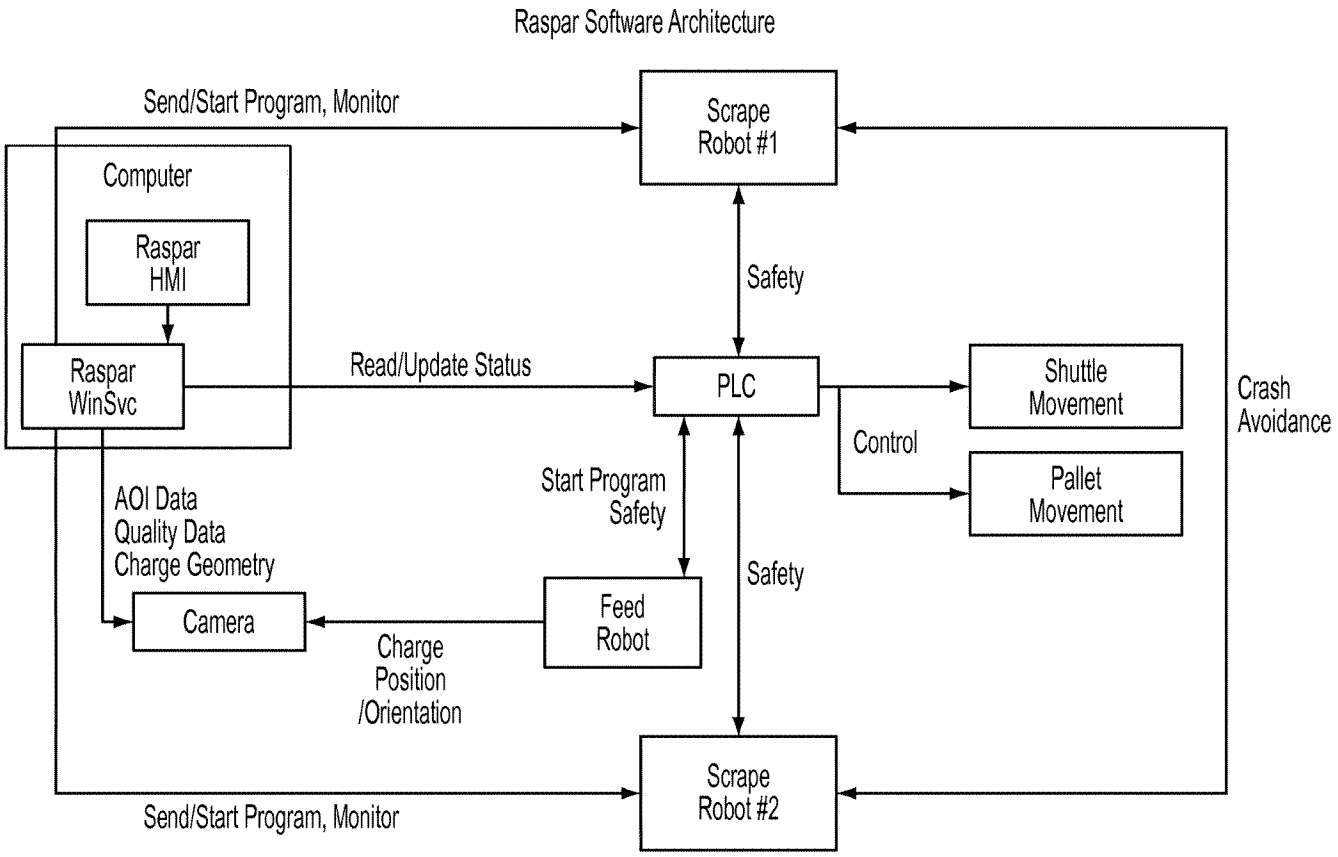
FIG. 9 is a schematic diagram illustrating an exemplary software architecture for the texturing system.
Figure 10:
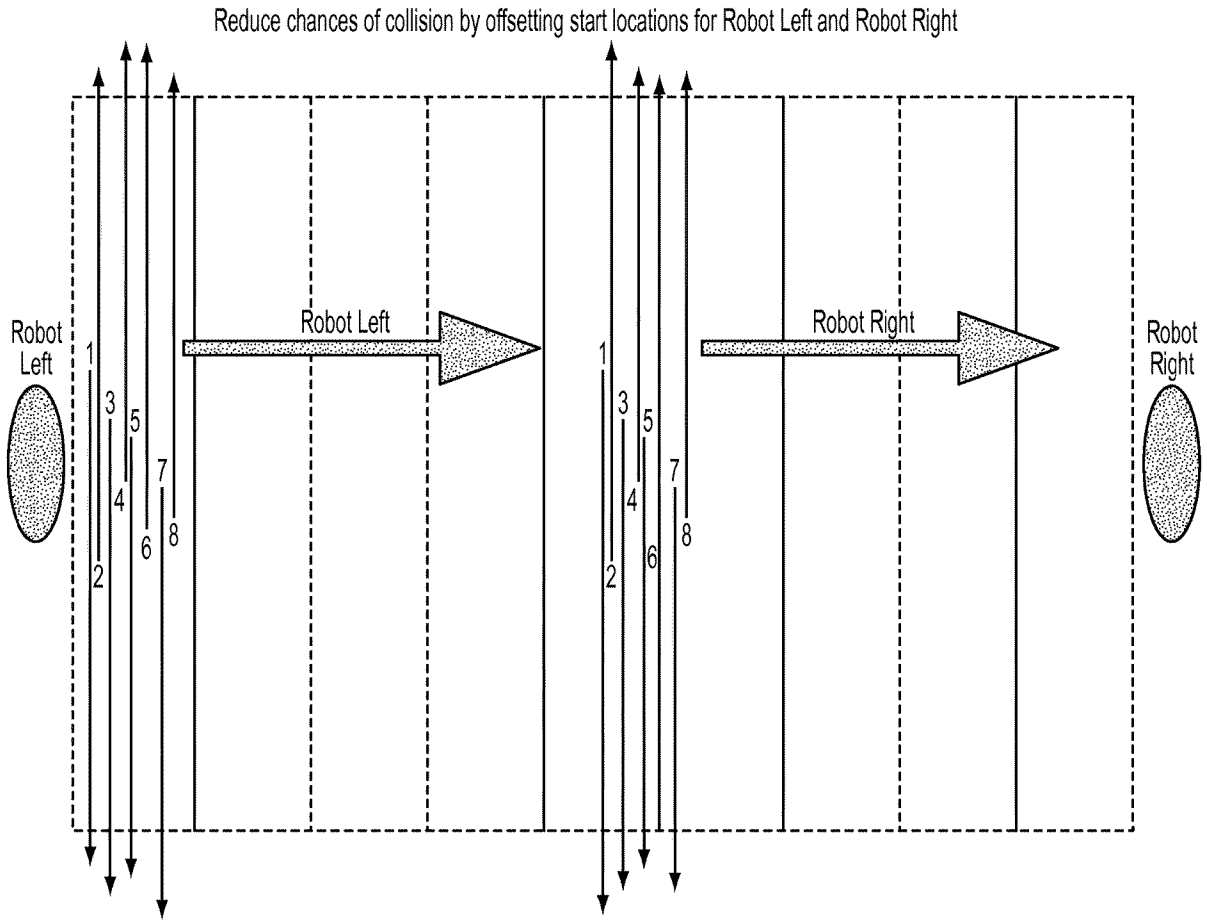
FIG. 10 is a schematic diagram illustrating an exemplary texturing pass pattern for two opposing texturing assemblies on the upper surface of the charge.

Referring to FIG. 9, based on the image of the respective charge 5 and the programmed system parameters, the programmable controller 30 can be configured and programmed to determine a random abrasion pattern for the charge. Subsequent to the movement of the subject charge to the abrasion position, the abrasion assembly 60 can be controlled via the programmable controller in accord with the random abrasion pattern to selectively engage and remove desired portions of the upper surface of the charge with the at least one abrasion assembly 60 to form a randomized textured surface effect thereon the upper surface of the charge.

Figure 7:
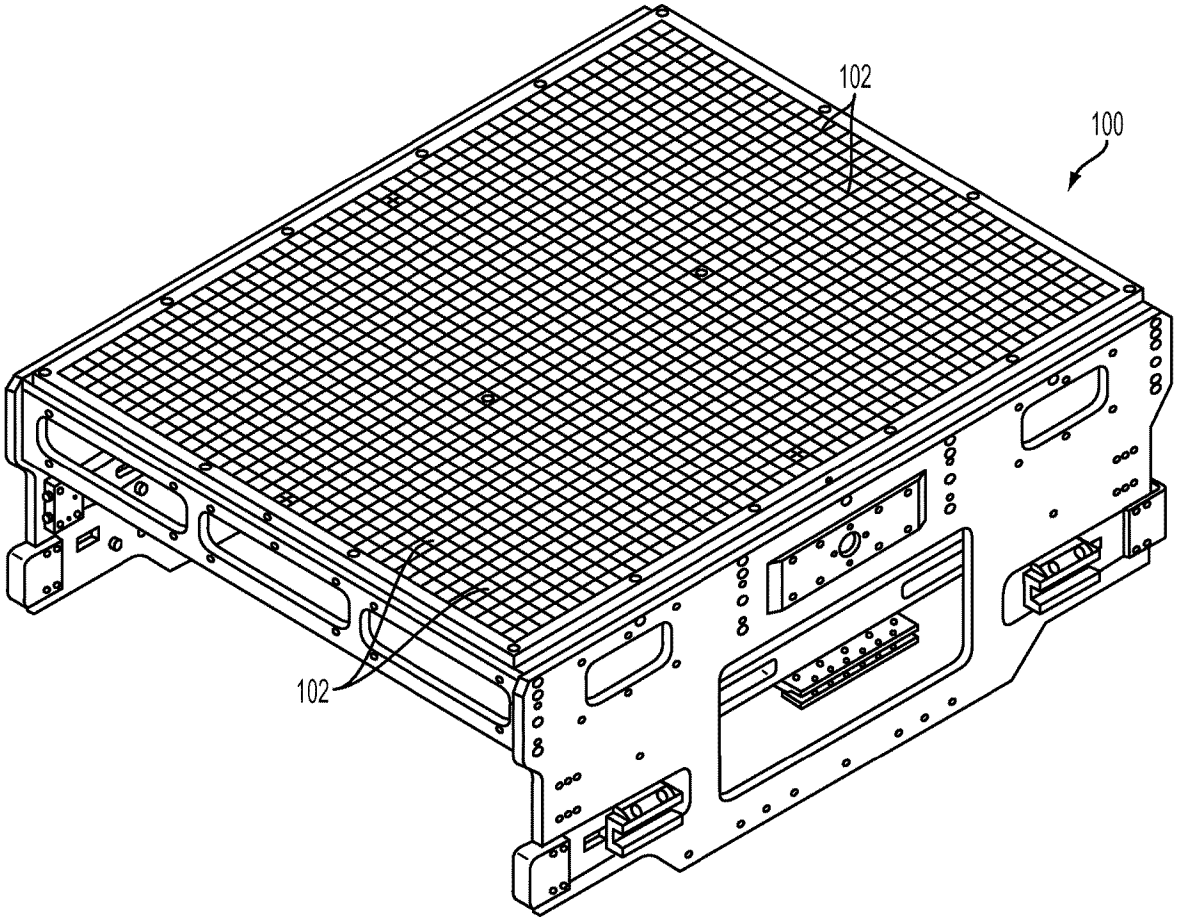
FIG. 7 is a perspective view of a shuttle assembly of the texturing system of FIG. 3.

In one aspect, it is contemplated that the texturing system 40 can comprise at least one shuttle assembly 80 that can be configured to be moved from a loading and scanning position to the abrasion position along a machine direction. Each shuttle assembly can comprise a table. Further, it is contemplated that the table of each shuttle assembly comprises a means for selectively adhering the charge supporting surface of the table to the lower surface of the charge 5 until the desired randomized textured surface effect is formed. In one aspect and as shown in FIG. 7, the means for selectively adhering the charge can comprise a charge supporting surface 100 and a plurality of openings 102 in the charge supporting surface in communication with a vacuum source. Here, it is contemplated the charge supporting system can further comprise multiple layers configured to evenly distribute the vacuum pressure with minimal leakage. In one exemplary aspect, the bottom most layer comprises a milled PVC manifold plate, where each plate is further configured with 4 zones having 4 vacuum holes per zone. Next, a 5/16" MDF board is mounted on top of the manifold plate, where the MDF board is configured to have vacuum pulled all the way through. Then, a ½" closed cell foam is provided at the perimeter of the manifold plate to seal the edges from leakage. It is contemplated that pressure equal to at least 15 inches of mercury be maintained to secure the charge 5. It is thus contemplated that release or slippage during texturing of the charge can be minimized or eliminated.

In operation, it is contemplated that the shuttle assembly 80 can comprise a pair of shuttle assemblies that can reciprocatively move or drive the respective tables of the shuttle assemblies along the machine direction. In this aspect, the pair of shuttle assemblies can comprise an upper shuttle assembly and a lower shuttle assembly that can be configured so that the lower shuttle assembly can pass under and through a U shaped channel in the bottom of the upper shuttle assembly. In this aspect, it is contemplated that the respective upper and lower shuttle assemblies, with charges disposed on the respective charge supporting surface 100, can operatively pass each other along the machine direction in operation.

In another aspect, a conventional servo motor can be used to selectively drive the table of the shuttle assembly under control of the at least one programmable controller 30. In this aspect, the servo motor can be configured to drive the table bi-axially along the machine direction under control of the at least one programmable controller. Further, the table can be configured to remain substantially fixed in the abrasion position until the desired randomized textured surface effect is formed.

In a further aspect, it is contemplated that the abrasion position can provide selective access of the abrasion assembly 60 to the charge 5 positioned thereon the table of the shuttle assembly. It is also contemplated that only one shuttle assembly will be positioned in the abrasion position at a time. Thus, only after the desired randomized textured surface effect is formed on the charge, with the shuttle assemblies swap positions.

In another aspect, the at least one abrasion assembly 60 is operatively coupled to at least one tool assembly 50. As shown in the figures, it is contemplated that a pair of opposed robotic action devices, such as manufactured by ABB Inc., Model No. IRB 4600, under control of the programmable controller 30 for selective multi-dimensional positioning of the tool assembly 50 relative to the upper surface of the charge (or more) can be used in the present production methodology. However, it is also contemplated that a single robotic action device could be used.

In a further aspect, the at least one abrasion assembly 60 can be selectively pivotally coupled to the tool assembly 50. In this aspect, a servo motor can be configured or utilized to affect a desired pivotal rotation of the at least one abrasion assembly relative to the tool assembly under control of the programmable controller 30. It is contemplated that the tool assembly can be formed as an operable and controllable portion of the robotic action device or can be a separate assembly operatively coupled to the robotic action device.

In a further aspect and referring to FIGS. 10-14B, it is contemplated that the random abrasion pattern generated by the programmable controller 30 can comprise a plurality of motion passes. In one aspect, each motion pass can be oriented with respect to the longitudinal axis of the charge 5 and to a desired start location on the upper surface of the charge. In a further aspect, each motion pass can comprise one or more of an approach segment, an abrasion segment and an exit segment.

In another aspect, the operational step of controlling the at least one abrasion assembly 60 can comprise controlling an approach angle of the at least one abrasion assembly relative to the upper surface of the charge 5 during the approach segment and an elongate length of the approach segment. Optionally, in another aspect, the operational step of controlling the at least one abrasion assembly can comprise controlling an exit angle of the at least one abrasion assembly relative to the upper surface of the charge 5 during the exit segment and an elongate length of the exit segment. In yet another optional aspect, the operational step of controlling the at least one abrasion assembly can comprise controlling a yaw angle of the at least one abrasion assembly relative to the longitudinal axis of the charge during the abrasion segment and an applied pressure of the at least one abrasion assembly thereon the upper surface of the charge throughout the abrasion segment.

Figure 11:
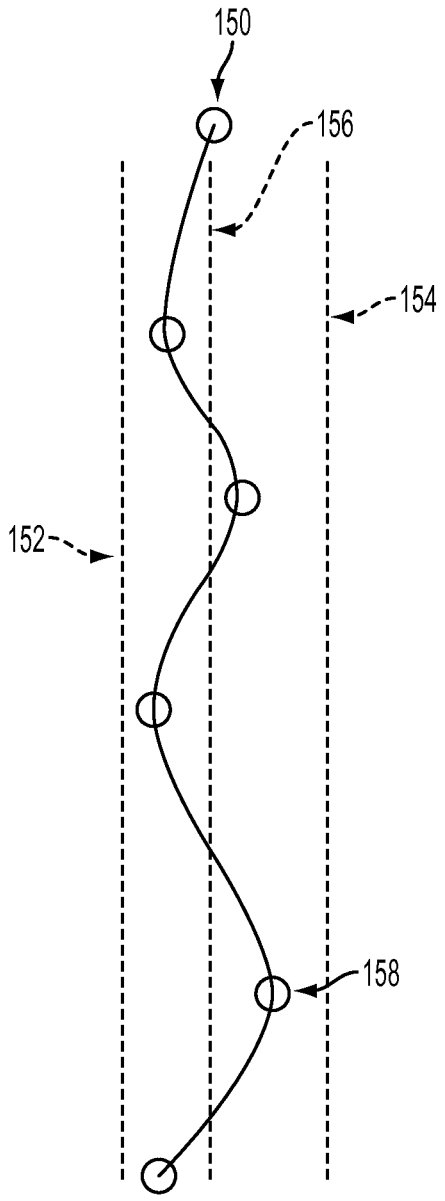
FIG. 11 is a schematic diagram illustrating a top elevational view of an exemplary motion pass of an abrasion assembly on the upper surface of the board.
Figure 12:
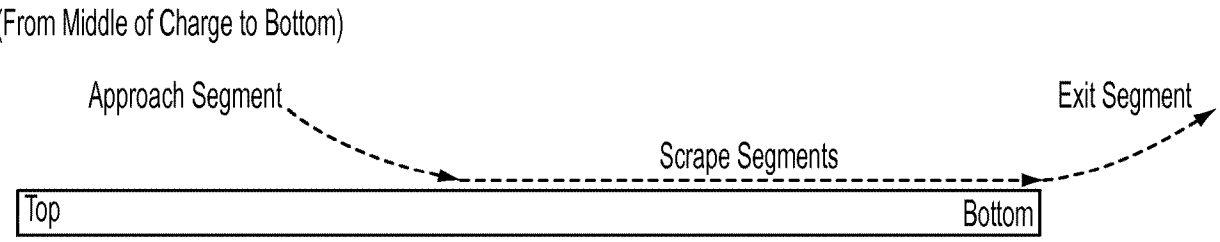
FIG. 12 is a schematic diagram illustrating a side elevational view of an exemplary motion pass in a first motion direction of an abrasion assembly on the upper surface of the board.
Figure 13:
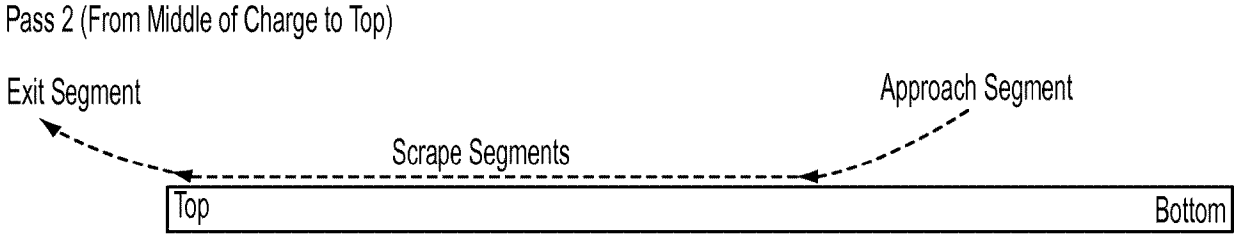
FIG. 13 is a schematic diagram illustrating a side elevational view of an exemplary motion pass in a second motion direction, opposite to the first motion direction, of an on the upper surface of the board.

Referring to FIG. 11, in another aspect, each abrasion segment of each motion pass can have a random start position 150, a randomized X minimum 152, a randomized X maximum 154 and a median pass axis 156. In this aspect, a randomized zone tolerance 158 can be provided that determines the distance between the median pass axis 156 and either the x minimum 152 or X maximum 154 achieved by the abrasion assembly 60 before moving to the next position. In this aspect, it is contemplated that each abrasion segment can further comprise a plurality of elongated axial abrasion sections. In another aspect, selected portions of each elongated axial abrasion section can be angled with respect to the longitudinal axis of the charge 5 such that portions of each elongated axial abrasion section can be offset from the median pass axis at a distance transverse to the median pass axis.

It is further contemplated that distinct looks or personalities can be created by varying the minimum and maximum limits of each variable. Even further, groups of such personalities can be programmed or otherwise integrated into the automated scraping system 40 and can be selectively recalled to create a product style. It is contemplated that the automated texturing system 40 can include about 90 personality or parameter sets and 30 minimum/maximum pairs to produce a desired look.

As one skilled in the art would contemplate, in one aspect, adjoining motion passes can be offset from each other at a randomized distance. Further, in an optional aspect, at least a portion of adjoining motions passes can overlap.

Figure 14A:
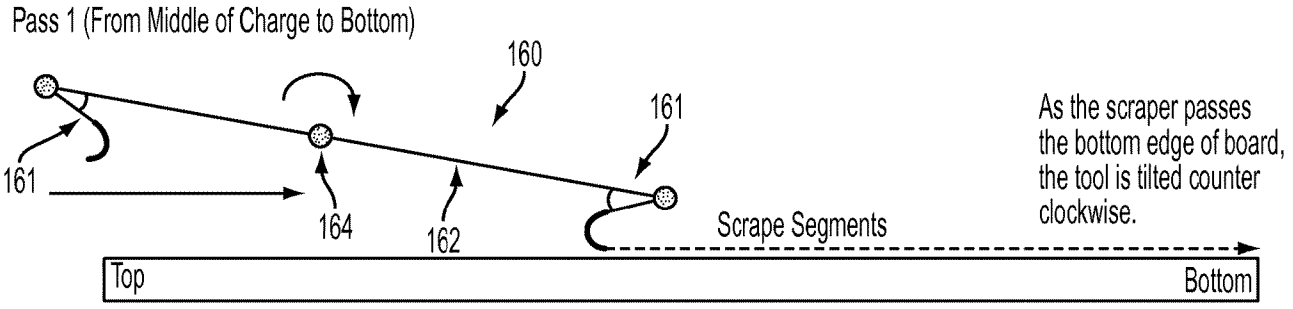
FIGS. 14A and 14B are schematic diagrams showing side elevational views of a random scraping pattern comprising a plurality of motion passes, each motion pass being oriented with respect to the longitudinal axis of the charge and a desired start location on the upper surface of the charge. In this aspect, adjacent motion passes are oriented in opposite directions and a first abrasion assembly, for example at least one scraping blade, is configured to contact the charge under control of the programmable controller during motion passes in a first direction and a second abrasion assembly, for example at least one second scraping blade, is configured to contact the charge under control of the programmable controller during motion passes in a second, opposite direction.
Figure 14B:
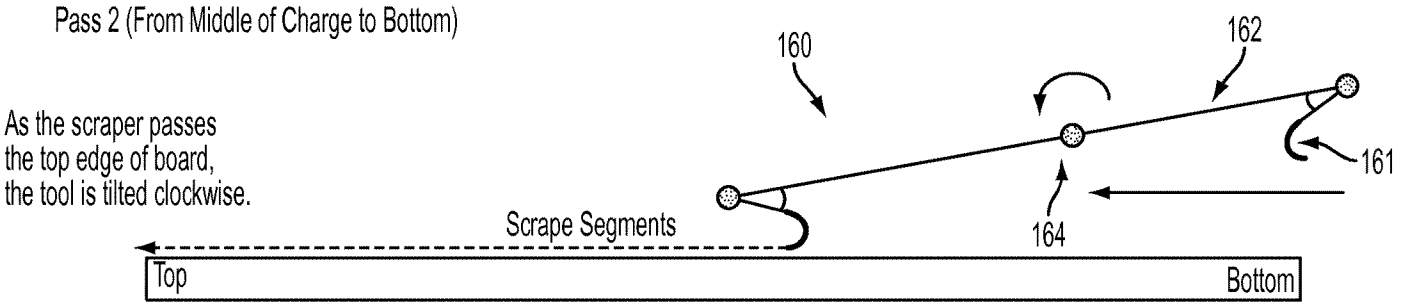

In one embodiment, the at least one abrasion assembly 60 can comprise a scraping gantry 160 having at least one scraping blade 161. It is also contemplated that the at least one scraping blade can comprise a pair of spaced scraping blades. In one exemplary aspect and as shown in FIGS. 14A and 14B, the tool assembly 50 can comprises an elongate body 162 that can be configured to be selectively and controllably pivotally rotatable about a center point 164 by the programmable controller 30. In this aspect, a first scraping blade(s) 161 of the pair of spaced scraping blades can be pivotally coupled to the tool assembly at a first end portion of the elongate body and a second scraping blade(s) 161 of the pair of spaced scraping blades can be pivotally coupled to the tool assembly at a second end portion. In other aspects, each blade used in the scraping gantry can be ground to a different radius or shape or be configured by a CNC to vary the scrape pattern. In other additional or alternate aspects, the blade pressure applied to each blade of the scraping gantry can be varied using, for example and without limitation, proportional valves and the like.

In a further aspect, the tool assembly 50 can also have a handle that can be operatively coupled to the at least one blade 161. In one aspect, it is contemplated that the handle can be substantially rigid or can have a desired degree of compliance and/or flexibility. As one skilled in the art will appreciate, having additional flexibility in the portion of the tool assembly 50 that contacts the blade, i.e., the handle, can, along with the previously described randomization), allow the user to create the desired degree of chatter in the texture marks formed by the blade passage therethrough the board. In one aspect, the handle can comprise a composite structure formed from stacked layers of thin pieces of spring steel. Having a portion of the at least one blade being coupled to a portion of the stacked composite formed of spring steel is one non-limiting example suitable for provided the desired chatter in the texture marks.

In this aspect, it is contemplated utilizing the robotic action device under control of the programmable controller 30 for selective multi-dimensional positioning of the tool assembly 50 relative to the upper surface of the charge 5. It is also contemplated utilizing the robotic action device under control of the programmable controller for selective rotation of the tool assembly about the center point to selectively apply only one scraping blade 161 of the pair of spaced scraping blades into programmed operative contact with the upper surface of the charge in a motion pass.

In some aspects, it can be desirable to induce chatter in the automated texturing system 40 via, for example and without limitation, a vibration device, and the blade angle, blade thickness, and blade pressure of an abrasion assembly 60 applied to the charge surface.

In other aspects, the automated texturing system 40 can further comprise a vibration device adapted to increase the amount of chatter imparted to the charge 5 during a texturing operation. It is contemplated that the vibration device be further adapted to selectively apply short-term chatter marks. It is also contemplated that a pneumatic air vibration device comprising an additional port adapted to allow excess air to escape more rapidly, allowing the offset rotary cam vibrator to stop and start at a faster rate than without the additional port. In an additional or alternative aspect, the air vibration device can further comprise a "bang bang" valve adapted to throw air in the opposite direction in order to stop the rotator from rotating. Here, one skilled in the art will appreciate that the additional port and the "bang bang" valve enables the vibration device to be more responsive with much faster control and, further, to be cut on and off with nearly an instantaneous response. In one exemplary aspect, a Vimarc Gt-10 pneumatic air vibration device can be modified as detailed above and employed in the automatic texturing system. Even further, it is contemplated that the settings of the vibration device can be from about 0 to about 100 p.s.i., and, more preferably, from about 0 to about 60 p.s.i.

In other aspects, it is further contemplated that chatter can be applied by using a hook or pivot angle of from about 1 to about 2 degrees, pressure and vibration device settings. Further, a scraping pattern having increased randomness can be generating by adapting the blades of the scraping gantry to change the pivot angle of each of the plurality of scraping blades. In light of the present disclosure, one skilled in the art will appreciate that such an adaptation can be accomplished through the use of, for example and without limitation, an air cylinder, a linear stepper, a servo motor, a linear actuator or the like.

In other aspects, it is contemplated that chatter can be caused by the characteristics of the charge 5.

In other aspects, the blade of the scraping gantry can be modified to have at least one bead along the blade edge and such feature can be created during the grinding and sharpening process. A blade having at least one bead can be selectively used to produce wobble and scallop. Wobble is used to describe pattern zig-zag and can be controlled by the pattern "Pass Width" parameters. In one exemplary aspect, typical values can be from about +5 mm to about −5 mm. Scallop can be created by varying the blade angle throughout the scrape. In one exemplary aspect, a 5 degree blade angle can be configured to have a +/−1 degree variation.

It is further contemplated to provide a means for changing the blades 161 of the scraping gantry 160. In one aspect, a quick disconnect puck provided on the tool assembly 50 can be used to replace a scarping gantry having dull blades with a new scraping gantry having sharp blades. It is contemplated that his quick disconnect puck can have a self-contained pneumatic and electrical connections, allowing the scraping gantry to be replaced rapidly. In another aspect, a blade station can be provided. Here, the tool assembly 50 can position at least one scraping gantry 160 at a blade change station and cause a plurality of quick release blade holders to drop the dull blades. Next, the gantry can be indexed forward by a few inches to a blade load position. Here, preloaded blades mounted in temporary blade holders have been secured to precision pneumatic linear slides and are configured to allow each new blade to be accurately and simultaneously transferred to each of the plurality of blade holders on the scraping gantry. Each blade holder on the scraping gantry can have both an alignment pin and a load bearing pin to secure and locate each blade into its proper position. Further, each pin can be configured to be retracted and engaged automatically. Once each blade has been properly positioned within the plurality of blade holders, the pins can align to secure the blade within the blade holder. As one skilled in the art will appreciate, sensors can be provided that can be configured to confirm that all blades and pins are properly positioned. In yet other aspects, the present disclosure provides a system for collecting dull blades into a stack for sharpening. Here, the scraping gantry can use six pre-stacked sharp blade magazines for automatic loading into the temporary blade holders. This can allow unattended operation of the blade changing process, further reducing labor requirements.

In yet another aspect, it is contemplated that a square blade can be provided and configured to be rotated into four different positions in the scraping gantry, cutting down on the number of blade changes needed and the corresponding machine down time.

In another aspect, a method for blade sharpness sensing is contemplated and comprises measuring the vibration of the scraping gantry. Here, as a blade dulls, the scraping gantry will undergo more vibration and, accordingly, vibration, torque, motor amperage or the like can be used to determine when blades need to be changed.

As shown in FIGS. 14A and 14B, in this production methodology the random scraping pattern can comprise a plurality of motion passes. In this aspect, each motion pass can be oriented with respect to the longitudinal axis of the charge 5 and a desired start location on the upper surface of the charge. Further, adjacent and or adjoining motion passes can be oriented in opposite directions. In another optional aspect, the first scraping blade can be configured to contact the charge under control of the programmable controller 30 during motion passes in a first direction and the second scraping blade can be configured to contact the charge under control of the programmable controller during motion passes in a second, opposite direction. In this aspect, it is contemplated that the first scraping blade faces toward the first end of the elongate body 162 and the second scraping blade faces toward the second end of the elongate body.

In yet another aspect, a first servo motor can be configured to pivotally rotate the first scraping blade relative to first end portion of the tool assembly 50 under control of the programmable controller 30 and a second servo motor can be configured to pivotally rotate the second scraping blade relative to second end portion of the tool assembly under control of the programmable controller. One skilled in the art will appreciate that the servo motors are merely exemplary and conventional controllable means for actuating can be used, such as, for example and without limitation, air cylinders with programmed stop positions, and the like.

Figure 15:
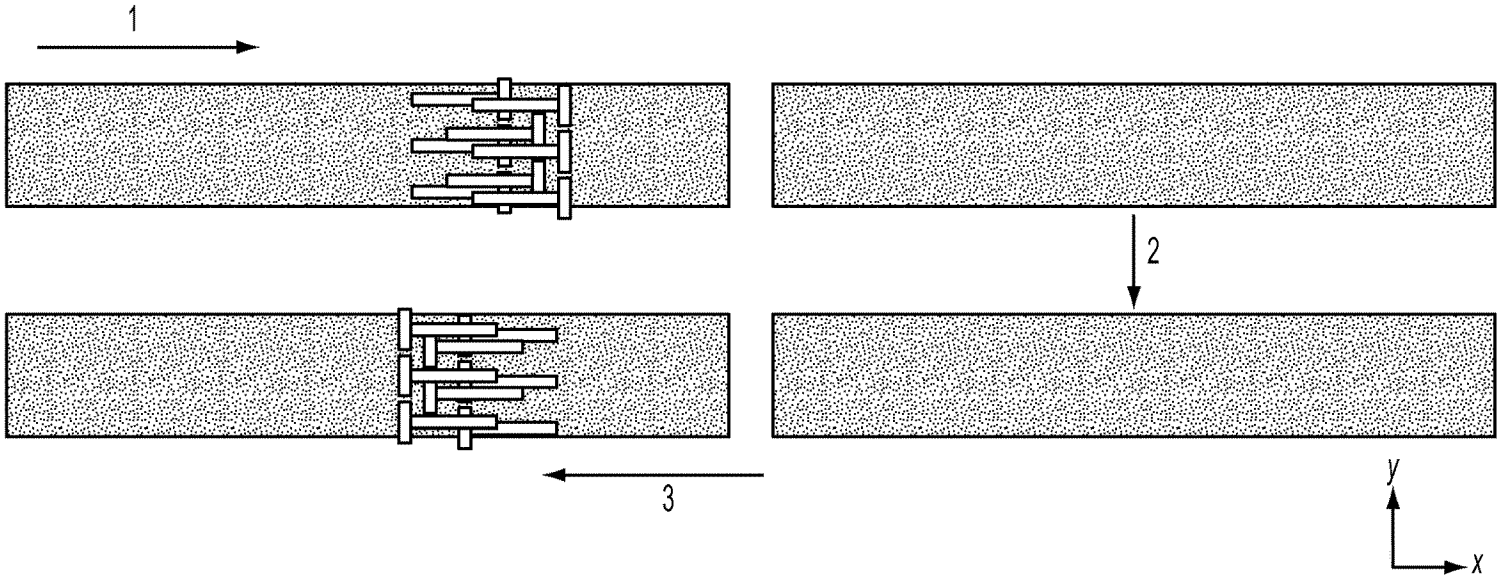
FIG. 15 depicts one optional methodology for using the system described herein.

In a further aspect, and referring to FIG. 15, an optional methodology for using the system described herein is illustrated. In this example, a charge 5 can be urged or otherwise moved in a first machine direction (arrow 1) along a first machine axis on a conveyor under a first set of scrapers to randomly scrape a left hand side of the charge in accord with a random abrasion pattern. Usually, during the scraping process, the boards can be held stationary by the vacuum hold-down system located on the shuttle plate top and the robot moves the blades over the fixed board for creating the random distressed look. In this aspect, it is contemplated that each scraper can move independently in a vertical direction leading up and throughout the scrape of the board to produce a random elongate path generally in the machine direction along the scraped portion of the charge. It is also contemplated that each blade can be brought in contact with the board under independent control to vary where the respective texture marks or scrape paths start. Optionally, the blade angle and pressure can be varied on each scraper blade independently throughout the scrape to produce random variation in the depth of the scrape along the board. In a further aspect, each blade can be brought out of contact with the board and back into contact with the board independently as the board passes underneath the blade in the machine direction to aid in creating a natural scraped texture. It is also contemplated that one or more blades, or a plurality of blades, can be used as desired to help create the desired texture.

Subsequent to the original pass in the machine direction, the charge 5 can be driven in a transverse direction (arrow 2) so that the longitudinal axis of the charge can be parallel to and spaced a predetermined distance from the first machine axis. Next, the charge can be urged or otherwise moved in a second machine direction (arrow 3 along a second machine axis on a conveyor under a first set of scrapers to randomly scrape a right hand side of the charge in accord with a random abrasion pattern. The second machine direction can be opposite to the first machine direction and the first and second machine axis can be substantially parallel to each other. In this aspect, the blades of the second set of scrapers can be oriented in an opposite direction relative to the first set of scrapers (due to the opposed second machine direction). Further, it is contemplated that the second set of scrapers can be operated in a similar random, independent modality as the first set of scrapers described above.

Figure 16:
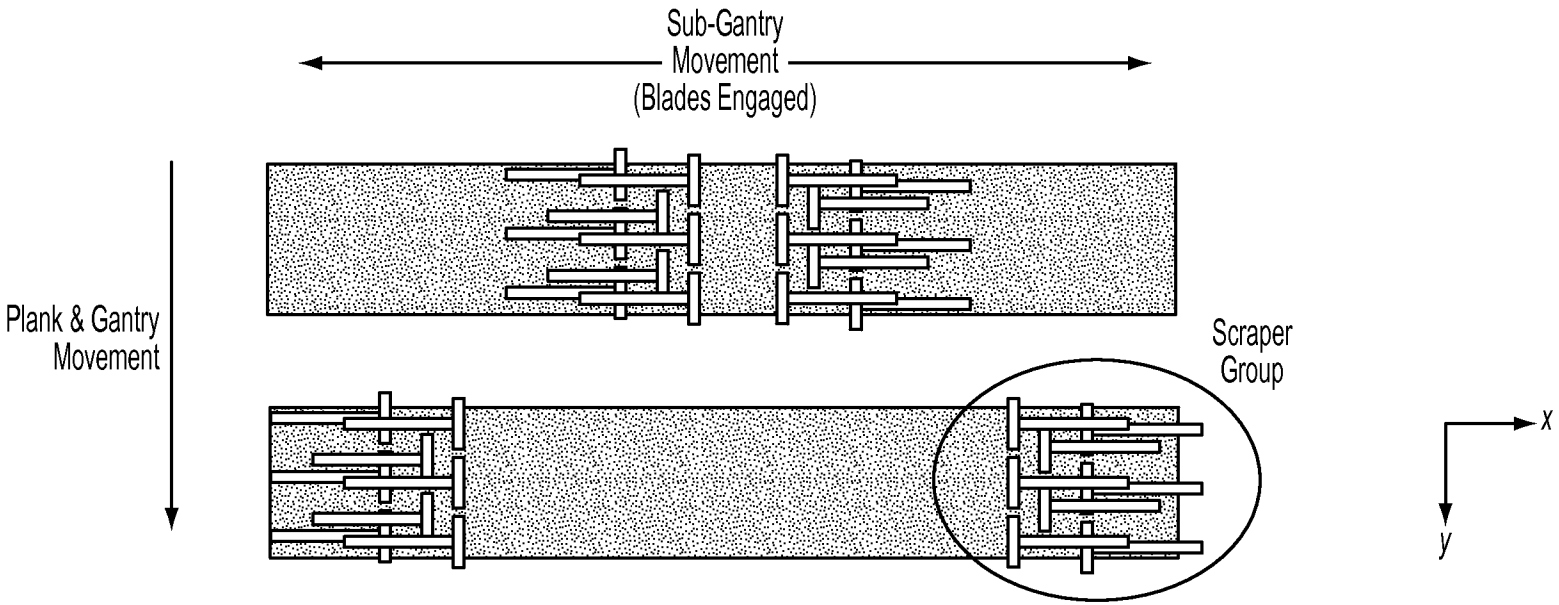
FIG. 16 depicts another optional methodology for using the system described herein.

In a further aspect and as illustrated in FIG. 16, an additional optional methodology for using the system described herein is illustrated. In this example, charge 5 can be urged or otherwise moved in a first machine direction (arrow 1) along a first machine axis. In this example, the tool assembly 50 can be coupled to a gantry that moves in the first machine direction so that the gantry maintains its relative position to the charge. In one example, the tool assembly comprises a plurality of scrapers or blades. Further, it is contemplated that the tool assembly can be configured to drag the plurality of scrapers in a direction transverse to the first machine direction from the proximate center of the charge to the outer transverse edges of the charge.

In this exemplary aspect, it is contemplated that each scraper can move independently in a vertical direction leading up and throughout the scrape of the board to produce a random elongate path generally in the machine direction along the scraped portion of the charge. It is also contemplated that each blade of the scraper can be brought in contact with the board under independent control to vary where the respective texture marks or scrape paths start. Optionally, the blade angle and pressure can be varied on each scraper blade independently throughout the scrape to produce random variation in the depth of the scrape along the board. In a further aspect, each blade can be brought out of contact with the board and back into contact with the board independently as the board passes underneath the blade in the machine direction to aid in creating a natural scraped texture. It is also contemplated that one or more blades, or a plurality of blades, can be used as desired to help create the desired texture.

It will be apparent to those skilled in the art that various modifications and variations can be made in the present invention without departing from the scope or spirit of the invention. Other aspects of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method, comprising:

releasably securing a charge on a table, wherein the charge has an upper surface and a longitudinal axis;

scanning the upper surface of the charge using a machine vision system to identify any defects present on the upper surface of the charge;

for each identified defect, defining a respective area of interest that bounds the identified defect;

creating a randomized textured surface effect for the charge based on a selected personality and any defined areas of interest with at least one programmable controller; and controlling at least one abrasion assembly with the at least one programmable controller in accord with the randomized textured surface effect to selectively engage and remove desired portions of the upper surface of the charge with the at least one abrasion assembly to form the randomized textured surface effect in the upper surface of the charge, wherein the randomized textured surface effect comprises a plurality of motion passes, each motion pass being oriented with respect to the longitudinal axis of the charge and a desired start location on the upper surface of the charge, wherein each motion pass comprises an approach segment, an abrasion segment, and an exit segment, and wherein controlling the at least one abrasion assembly comprises monitoring and controlling an applied pressure of the at least one abrasion assembly on the upper surface of the charge throughout the abrasion segment of each motion pass.

2. The method of claim 1, wherein the charge comprises at least one board.

3. The method of claim 2, wherein the at least one board comprises a flooring board.

4. The method of claim 2, wherein the at least one board comprises a wall board.

5. The method of claim 2, wherein the charge comprises a plurality of boards, wherein each board has a longitudinal axis, and wherein the plurality of boards are positioned in adjoining relationship in which the longitudinal axis of each of the plurality of boards is positioned substantially parallel to the longitudinal axis of the charge.

6. The method of claim 1, wherein the table is part of a shuttle assembly that moves the charge from a loading position to an abrasion position along a machine direction, and further comprising driving the table from the loading position to the abrasion position along the machine direction.

7. The method of claim 6, further comprising utilizing a servo motor to drive the table of the shuttle assembly under control of the at least one programmable controller.

8. The method of claim 7, wherein the servo motor drives the table of the shuttle assembly bi-axially.

9. The method of claim 6, further comprising, prior to releasably securing the charge on the table, selectively positioning the charge to a predetermined position relative to both a center point of the table and the longitudinal axis of the table.

10. The method of claim 6, wherein the table is substantially fixed in the abrasion position until the randomized textured surface effect is formed in the upper surface of the charge.

11. The method of claim 10, wherein the table comprises a means for selectively adhering the charge to the table until the randomized textured surface effect is formed in the upper surface of the charge.

12. The method of claim 11, wherein the means for selectively adhering the charge to the table comprises a charge supporting surface of the table having a plurality of openings disposed therein that are in communication with a vacuum source.

13. The method of claim 6, wherein the charge comprises a plurality of boards, wherein each board of the plurality of boards has a pair of long side edge surfaces that further comprise a means for selectively connecting adjoining long side edges of adjacent boards.

14. The method of claim 1, further comprising scanning the charge to determine the position of the charge on the table.

15. The method of claim 1, wherein controlling the at least one abrasion assembly comprises controlling an approach angle of the at least one abrasion assembly relative to the upper surface of the charge during the approach segment and an elongate length of the approach segment.

16. The method of claim 1, wherein controlling the at least one abrasion assembly comprises controlling an exit angle of the at least one abrasion assembly relative to the upper surface of the charge during the exit segment and an elongate length of the exit segment.

17. The method of claim 1, wherein controlling the at least one abrasion assembly comprises controlling a yaw angle of the at least one abrasion assembly relative to the longitudinal axis of the charge during the abrasion segment.

18. The method of claim 1, wherein each abrasion segment of each motion pass has a random start position and a median pass axis and further comprises a plurality of elongated axial abrasion sections, and wherein selected portions of each elongated axial abrasion section can be angled with respect to the longitudinal axis of the charge such that portions of each elongated axial abrasion section are offset from the median pass axis at a distance transverse to the median pass axis.

19. The method of claim 1, wherein adjoining motion passes are offset from each other at a randomized distance.

20. The method of claim 1, wherein at least a portion of adjoining motions passes overlap.

21. The method of claim 1, wherein the at least one abrasion assembly is coupled to a tool assembly.

22. The method of claim 21, further comprising utilizing a robotic action device under control of the programmable controller for selective multi-dimensional positioning of the tool assembly relative to the upper surface of the charge.

23. The method of claim 22, wherein the at least one abrasion assembly is pivotally coupled to the tool assembly.

24. The method of claim 23, further comprising utilizing a servo motor to pivotally rotate the at least one abrasion assembly relative to the tool assembly under control of the programmable controller.

25. The method of claim 24, wherein the at least one abrasion assembly comprises at least one scraping blade.

26. The method of claim 25, wherein the at least one scraping blade comprises a pair of spaced scraping blades.

27. The method of claim 26, wherein the tool assembly comprises an elongate body pivotally rotatable about a center point, wherein a first scraping blade of the pair of spaced scraping blades is pivotally coupled to the tool assembly at a first end portion of the elongate body and wherein a second scraping blade of the pair of spaced scraping blades is pivotally coupled to the tool assembly at an opposed second end portion of the elongate body.

28. The method of claim 27, further comprising utilizing a robotic action device under control of the programmable controller for selective multi-dimensional positioning of the tool assembly relative to the upper surface of the charge and for selective rotation of the tool assembly about the center point to selectively apply only one scraping blade of the pair of spaced scraping blades into programmed operative contact with the upper surface of the charge in a motion pass.

29. The method of claim 28, wherein the randomized textured surface effect comprises a plurality of motion passes, each motion pass being oriented with respect to the longitudinal axis of the charge and a desired start location on the upper surface of the charge; wherein adjacent motion passes are oriented in opposite directions, and wherein the first scraping blade contacts the charge under control of the programmable controller during motion passes in a first direction and the second scraping blade contacts the charge under control of the programmable controller during motion passes in a second, opposite direction.

30. The method of claim 29, wherein an operative end of the first scraping blade faces toward the first end portion of the elongate body and wherein an operative end of the second scraping blade faces toward the second end portion of the elongate body.

31. The method of claim 30, wherein the servo motor comprises a first servo motor and a second servo motor, and further comprising utilizing the first servo motor to pivotally rotate the first scraping blade relative to the first end portion of the tool assembly under control of the programmable controller and utilizing the second servo motor to pivotally rotate the second scraping blade relative to second end portion of the tool assembly under control of the programmable controller.

32. The method of claim 30, further comprising a means for pivotally rotating the first scraping blade relative to the first end portion of the tool assembly under control of the programmable controller and a means for pivotally rotating the second scraping blade relative to second end portion of the tool assembly under control of the programmable controller.

33. The method of claim 1, wherein the programmable controller uses random programming of system parameters associated with the selected personality to generate the randomized textured surface effect, wherein the system parameters comprise at least one of: blade angle, number of scrapes, lane change locations, valley distances from edges, valley depth, chatter intensity, chatter locations, and valley locations.

34. The method of claim 33, further comprising:

removing the charge from the table;

releasably securing a second charge on the table, wherein the second charge has an upper surface and a longitudinal axis;

creating a randomized textured surface effect based on a selected personality for the second charge with the at least one programmable controller; and controlling at least one abrasion assembly with the at least one programmable controller in accord with the randomized textured surface effect to selectively engage and remove desired portions of the upper surface of the second charge with the at least one abrasion assembly to form the randomized textured surface effect in the upper surface of the second charge, wherein all of the system parameters are randomly varied from at least one set value to determine a randomized textured surface effect for the second charge based on the selected personality for the second charge.

35. The method of claim 34, wherein each system parameter of the selected personality is assigned a predetermined range of variance.

36. The method of claim 35, wherein the predetermined range of variance for each system parameter varies for each personality of a plurality of personalities.

37. The method of claim 33, wherein the programmable controller comprises a random number generator that facilitates the random selection of a value for each system parameter associated with the selected personality to generate the randomized textured surface effect.

38. The method of claim 34, wherein each system parameter of the selected personality is assigned a predetermined range of variance from which the value for the system parameter is selected in order to create the randomized textured surface effect.

39. The method of claim 33, wherein the system parameters further comprise identified areas of interest.

40. The method of claim 39, wherein at least one system parameter is changed in each scraped segment that bisects any identified area of interest.

41. The method of claim 33, wherein the programmable controller uses random programming of blade pressures associated with the selected personality to generate the randomized textured surface effect.

42. The method of claim 1, further comprising controlling a level of vibration applied to the at least one abrasion assembly during formation of the randomized textured surface effect in the upper surface of the charge.

43. The method of claim 1, further comprising, for a plurality of charges, repeating the steps of:

releasably securing a charge on the table, the charge having an upper surface;

scanning the upper surface of the charge using a machine vision system to identify any defects present on the upper surface of the charge;

for each identified defect, defining a respective area of interest that bounds the identified defect;

creating a randomized textured surface effect for the charge based on a selected personality and any defined areas of interest of the charge with at least one programmable controller; and controlling the at least one abrasion assembly with the at least one programmable controller in accord with the randomized textured surface effect, wherein the randomized textured surface effect is different for each charge of the plurality of charges.

44. A method, comprising:

releasably securing a charge on a table, wherein the charge has an upper surface and a longitudinal axis;

scanning the upper surface of the charge using a machine vision system to identify any defects present on the upper surface of the charge;

for each identified defect, defining a respective rectangular area of interest that bounds the identified defect;

creating a randomized textured surface effect for the charge based on a selected personality and any defined rectangular areas of interest with at least one programmable controller; and controlling at least one abrasion assembly with the at least one programmable controller in accord with the randomized textured surface effect to selectively engage and remove desired portions of the upper surface of the charge with the at least one abrasion assembly to form the randomized textured surface effect in the upper surface of the charge, wherein the randomized textured surface effect comprises a plurality of motion passes, each motion pass being oriented with respect to the longitudinal axis of the charge and a desired start location on the upper surface of the charge, wherein each motion pass comprises an approach segment, an abrasion segment, and an exit segment, and wherein controlling the at least one abrasion assembly comprises monitoring and controlling an applied pressure of the at least one abrasion assembly on the upper surface of the charge throughout the abrasion segment.

45. The method of claim 44, wherein controlling the at least one abrasion assembly with the at least one controller comprises selectively adjusting a position of the at least one abrasion assembly to avoid the identified defects during formation of the randomized textured surface effect.

46. A method, comprising:

releasably securing a first charge on a table of a first shuttle assembly, wherein the first shuttle assembly moves the first charge from a loading position to an abrasion position in a hardwood texturing apparatus, wherein the first charge has an upper surface and a longitudinal axis;

releasably securing a second charge on a table of a second shuttle assembly, wherein the second shuttle assembly moves the second charge from the loading position to the abrasion position reciprocatively with respect to the first shuttle assembly in the hardwood texturing apparatus, wherein the second charge has an upper surface and a longitudinal axis;

moving the first charge to the abrasion position;

scanning the upper surface of the first charge using a machine vision system to identify any defects present on the upper surface of the first charge;

for each identified defect of the first charge, defining a respective area of interest that bounds the identified defect of the first charge;

creating a first randomized textured surface effect for the first charge based on a first selected personality and any defined areas of interest of the first charge with at least one programmable controller; and controlling at least one abrasion assembly with the at least one programmable controller in accord with the first randomized textured surface effect to selectively engage and remove desired portions of the upper surface of the first charge with the at least one abrasion assembly to form the first randomized textured surface effect in the upper surface of the first charge, wherein the first randomized textured surface effect comprises a plurality of motion passes, each motion pass being oriented with respect to the longitudinal axis of the first charge and a desired start location on the upper surface of the first charge, wherein each motion pass comprises an approach segment, an abrasion segment, and an exit segment, and wherein controlling the at least one abrasion assembly comprises monitoring and controlling an applied pressure of the at least one abrasion assembly on the upper surface of the first charge throughout the abrasion segment;

moving the second charge to the abrasion position;

scanning the upper surface of the second charge using the machine vision system to identify any defects present on the upper surface of the second charge;

for each identified defect of the second charge, defining a respective area of interest that bounds the identified defect of the second charge;

creating a second randomized textured surface effect for the second charge based on a second selected personality and any defined areas of interest of the second charge with at least one programmable controller; and controlling at least one abrasion assembly with the at least one programmable controller in accord with the second randomized textured surface effect to selectively engage and remove desired portions of the upper surface of the second charge with the at least one abrasion assembly to form the second randomized textured surface effect in the upper surface of the second charge, wherein the second randomized textured surface effect is different than the first randomized textured surface effect.

47. A method, comprising:

releasably securing a charge on a table, wherein the charge has an upper surface and a longitudinal axis;

scanning the upper surface of the charge using a machine vision system to identify any defects present on the upper surface of the charge;

for each identified defect of the charge, defining a respective area of interest that bounds the identified defect of the charge;

creating a randomized textured surface effect for the charge based on a selected personality and any defined areas of interest with at least one programmable controller; and controlling at least one abrasion assembly with the at least one programmable controller in accord with the randomized textured surface effect to selectively engage and remove desired portions of the upper surface of the charge with the at least one abrasion assembly to form the randomized textured surface effect in the upper surface of the charge, wherein the randomized textured surface effect comprises a plurality of motion passes, each motion pass being oriented with respect to the longitudinal axis of the charge and a desired start location on the upper surface of the charge, wherein each motion pass comprises an approach segment, an abrasion segment, and an exit segment, and wherein controlling the at least one abrasion assembly comprises monitoring and controlling an applied pressure of the at least one abrasion assembly on the upper surface of the charge throughout the abrasion segment, wherein the at least one abrasion assembly comprises an elongate body that is pivotably rotatable about a center point having a first scraping blade coupled to a first end of the elongate body and a second scraping blade coupled to an opposed second end of the elongate body, and wherein controlling the at least one abrasion assembly to selectively engage and remove desired portions of the upper surface of the charge further comprises:

pivoting the elongate body to place the first scraping blade in operative contact with the charge;

moving the first scraping blade in a first direction with respect the longitudinal axis of the charge;

pivoting the elongate body to place the second scraping blade in operative contact with the charge; and moving the second scraping blade in an opposing second direction with respect to the longitudinal axis of the charge.

48. A method, comprising:

releasably securing a charge on a table, wherein the charge has an upper surface and a longitudinal axis;

scanning the upper surface of the charge using a machine vision system to identify any defects present on the upper surface of the charge;

for each identified defect of the charge, defining a respective area of interest that bounds the identified defect of the charge;

creating a randomized textured surface effect for the charge based on a selected personality and any defined areas of interest with at least one programmable controller;

controlling at least one abrasion assembly with the at least one programmable controller in accord with the randomized textured surface effect to selectively engage and remove desired portions of the upper surface of the charge with the at least one abrasion assembly to form the randomized textured surface effect in the upper surface of the charge, wherein the randomized textured surface effect comprises a plurality of motion passes, each motion pass being oriented with respect to the longitudinal axis of the charge and a desired start location on the upper surface of the charge, wherein each motion pass comprises an approach segment, an abrasion segment, and an exit segment, wherein controlling the at least one abrasion assembly comprises monitoring and controlling an applied pressure of the at least one abrasion assembly on the upper surface of the charge throughout the abrasion segment, and wherein the at least one abrasion assembly comprises a first at least one scraping blade;

indexing the at least one abrasion assembly to a blade change position and releasing the first at least one scraping blade; and indexing the at least one abrasion assembly to a blade load position and securing a second at least one scraping blade to the at least one abrasion assembly.

49. The method of claim 48, wherein releasing the first at least one scraping blade comprises using a quick disconnect device to release a plurality of dulled scraping blades from a plurality of blade holders of a scraping gantry, and wherein securing a second at least one scraping blade to the at least one abrasion assembly comprises transferring a plurality of new blades to the plurality of blade holders of the scraping gantry.

* * * * *